US011371243B2

(12) United States Patent
Jarvie

(10) Patent No.: US 11,371,243 B2
(45) Date of Patent: Jun. 28, 2022

(54) BUILDING PANEL

(71) Applicant: Armour Wall Group PTY Limited, Sydney (AU)

(72) Inventor: John Michael Jarvie, Cronulla (AU)

(73) Assignee: ARMOUR WALL GROUP PTY LIMITED, Sydney (AU)

( * ) Notice: Subject to any disclaimer, the term of this patent is extended or adjusted under 35 U.S.C. 154(b) by 46 days.

(21) Appl. No.: 16/464,080

(22) PCT Filed: Nov. 24, 2017

(86) PCT No.: PCT/AU2017/051297

§ 371 (c)(1),
(2) Date: May 24, 2019

(87) PCT Pub. No.: WO2018/094468

PCT Pub. Date: May 31, 2018

(65) Prior Publication Data

US 2019/0383013 A1 Dec. 19, 2019

(30) Foreign Application Priority Data

Nov. 26, 2016 (AU) ..... 2016904863

(51) Int. Cl.
*E04C 2/36* (2006.01)
*E04C 2/40* (2006.01)
(Continued)

(52) U.S. Cl.
CPC ..... *E04C 2/36* (2013.01); *E04B 2/562* (2013.01); *E04B 2/86* (2013.01); *E04B 2/8611* (2013.01);
(Continued)

(58) Field of Classification Search
CPC ..... E04C 2/36; E04C 2002/004; E04C 2002/3488; E04C 2/34; E04C 2/20;
(Continued)

(56) References Cited

U.S. PATENT DOCUMENTS 364,427 A * 6/1887 McCallip ..... E04H 12/2276 52/297
552,268 A * 12/1895 Wood ..... E04B 1/22 52/223.5
(Continued)

FOREIGN PATENT DOCUMENTS

DE 3918676 A1 * 8/1990 ..... E04B 2/721
EP 382084 A * 8/1990 ..... B29C 65/56
(Continued)

OTHER PUBLICATIONS

International Search Report and Written Opinion received in PCT/AU2017/051297, 8 pgs.
(Continued)

*Primary Examiner* — Robert Canfield
(74) *Attorney, Agent, or Firm* — Foley & Lardner LLP

(57) ABSTRACT

A panel is disclosed for use in construction. The panel comprises opposing surfaces that extend between first and second opposite ends. The panel also comprises a plurality of parallel (e.g. sawtooth) ridges. The ridges are provided on at least one of the opposing surfaces. The ridges extend along and adjacent to a first of the opposite ends of the panel for at least a part length thereof. The ridges are arranged to engage with and move past corresponding ridges of an adjacent panel when the panels move relative to each other in opposite directions. The ridges are further arranged so as to interfere with the ridges of the adjacent panel to resist relative movement in a reverse of the opposite direction.

20 Claims, 19 Drawing Sheets

(51) Int. Cl.

| | |
|---|---|
| ***E04B 2/86*** | (2006.01) |
| ***E04H 1/12*** | (2006.01) |
| ***E04B 2/56*** | (2006.01) |
| *E04C 2/00* | (2006.01) |
| *E04C 2/34* | (2006.01) |
| *E04G 11/06* | (2006.01) |

(52) U.S. Cl.
CPC ..... *E04B 2/8635* (2013.01); *E04C 2/40* (2013.01); *E04H 1/1205* (2013.01); *E04C 2002/004* (2013.01); *E04C 2002/3488* (2013.01); *E04G 11/06* (2013.01)

(58) Field of Classification Search
CPC ..... E04C 2/40; E04B 2/8611; E04B 2/8635; E04B 2/86; E04B 2/562; E04B 1/12; E04B 2002/867; E04B 2/8641; E04B 2002/8676; E04H 1/1205; E04G 11/06
USPC ..... 52/157, 223.4, 223.5, 223.6, 223.7, 52/223.14, 270, 271, 275, 300, 301, 52/309.9, 309.11, 425, 426, 568, 570, 52/574, 588.1, 591.2, 591.4, 592.1, 834, 52/848, 236.3, 241, 429, 578, 589.1, 52/793.1, 793.11
See application file for complete search history.

(56) References Cited

U.S. PATENT DOCUMENTS

| | | | | | |
|---|---|---|---|---|---|
| 937,794 | A * | 10/1909 | Haas | E04C 3/34 | 52/223.4 |
| 1,012,423 | A * | 12/1911 | Orr | E04F 11/02 | 52/184 |
| 1,185,871 | A * | 6/1916 | Broughton | E04B 7/08 | 52/89 |
| 1,746,672 | A * | 2/1930 | Nylund | E04F 11/1812 | 52/223.5 |
| 2,998,110 | A * | 8/1961 | Hutzelman | E04B 2/7433 | 52/301 |
| 3,037,590 | A * | 6/1962 | Pavlecka | E04C 2/08 | 52/481.2 |
| 3,330,084 | A * | 7/1967 | Russell | E04B 2/7809 | 52/300 |
| 3,452,498 | A * | 7/1969 | Kinsey | E04B 7/20 | 52/262 |
| 3,815,311 | A * | 6/1974 | Nisula | F16B 5/0016 | 52/579 |
| 3,828,502 | A * | 8/1974 | Carlsson | E04B 1/14 | 52/309.11 |
| 4,019,301 | A * | 4/1977 | Fox | E02D 5/60 | 52/834 |
| 4,104,838 | A * | 8/1978 | Hage | E04B 2/7433 | 160/135 |
| 5,245,803 | A * | 9/1993 | Haag | E04B 1/12 | 52/90.1 |
| 5,956,920 | A * | 9/1999 | Davis | E04F 11/1842 | 52/844 |
| 5,992,114 | A * | 11/1999 | Zelinsky | E04B 2/8652 | 249/216 |
| 6,199,340 | B1 * | 3/2001 | Davis | C08L 23/10 | 52/100 |
| 6,216,409 | B1 * | 4/2001 | Roy | E04F 13/08 | 52/588.1 |
| 6,226,950 | B1 * | 5/2001 | Davis | C08L 23/10 | 52/100 |
| 6,256,960 | B1 * | 7/2001 | Babcock | E04B 1/14 | 52/281 |
| 6,286,281 | B1 * | 9/2001 | Johnson | B29C 70/525 | 52/309.9 |
| 6,352,237 | B1 * | 3/2002 | Severino | E04B 2/8652 | 249/194 |
| 6,591,558 | B1 * | 7/2003 | De Zen | E04B 1/12 | 52/91.1 |
| 6,658,808 | B1 * | 12/2003 | Doherty | E04B 1/12 | 52/579 |
| 6,718,721 | B2 * | 4/2004 | Albany | E04C 2/292 | 52/581 |
| 7,444,782 | B2 * | 11/2008 | Crowell | E04B 1/12 | 52/264 |
| 7,568,323 | B2 * | 8/2009 | Shelton | E04C 3/06 | 52/579 |
| 8,074,424 | B2 * | 12/2011 | Waters | E04C 3/30 | 52/834 |
| 8,342,485 | B2 * | 1/2013 | McGinness | E04H 12/2253 | 256/65.14 |
| 8,443,576 | B2 * | 5/2013 | Petta | E04C 3/30 | 52/835 |
| 8,677,713 | B1 * | 3/2014 | Sheehy | E04C 2/388 | 52/588.1 |
| 8,769,904 | B1 * | 7/2014 | Brandt | E04F 15/02038 | 52/588.1 |
| 10,364,570 | B2 * | 7/2019 | Johnston | E04G 11/06 | |
| 10,519,658 | B1 * | 12/2019 | Herron, III | E04C 3/34 | |
| 10,787,829 | B1 * | 9/2020 | Meyer | E04H 1/005 | |
| 11,060,282 | B2 * | 7/2021 | Spear | E04B 1/12 | |
| 2003/0145555 | A1 * | 8/2003 | Raskin | E04C 3/06 | 52/844 |
| 2003/0167711 | A1 * | 9/2003 | Lstiburek | E04B 1/26 | 52/223.4 |
| 2004/0103601 | A1 * | 6/2004 | Bergqvist | E04D 3/363 | 52/284 |
| 2005/0016103 | A1 * | 1/2005 | Piccone | E04B 2/8641 | 52/481.1 |
| 2005/0086881 | A1 * | 4/2005 | Greenberg | E02D 27/02 | 52/292 |
| 2006/0096184 | A1 * | 5/2006 | Kraaijkamp | E04H 12/2223 | 52/157 |
| 2006/0251865 | A1 * | 11/2006 | Hinterneder | F24S 70/14 | 428/188 |
| 2007/0094963 | A1 * | 5/2007 | McDonald | E04B 1/34321 | 52/270 |
| 2007/0101678 | A1 * | 5/2007 | Miniter | E04B 2/58 | 52/782.1 |
| 2007/0289245 | A1 * | 12/2007 | Welch | E04D 3/362 | 52/592.1 |
| 2012/0011798 | A1 * | 1/2012 | Rivellino | E04B 1/4157 | 52/655.1 |
| 2012/0031017 | A1 * | 2/2012 | Stroyer | E01D 19/02 | 52/157 |
| 2013/0192155 | A1 * | 8/2013 | Bergeron | E04C 2/40 | 52/309.1 |
| 2013/0305650 | A1 * | 11/2013 | Liu | E04F 15/02033 | 52/592.1 |
| 2014/0360121 | A1 * | 12/2014 | Richardson | E04F 13/24 | 52/588.1 |
| 2016/0076239 | A1 * | 3/2016 | Espinosa | E04B 1/26 | 52/236.3 |
| 2016/0289960 | A1 * | 10/2016 | Darwell | E04B 2/8635 | |
| 2016/0340899 | A1 * | 11/2016 | Piccone | E04B 2/86 | |
| 2020/0149240 | A1 * | 5/2020 | Jarvie | E02D 5/38 | |
| 2021/0140184 | A1 * | 5/2021 | Saadie | E06B 1/02 | |

FOREIGN PATENT DOCUMENTS

| | | | | |
|---|---|---|---|---|
| EP | 3486391 | A1 * | 5/2019 | E04B 2/8647 |
| JP | 02035136 | A * | 2/1990 | |
| WO | 2007001396 | A2 | 1/2007 | |
| WO | 2009/033201 | A1 | 3/2009 | |
| WO | WO-2009/033201 | A1 | 3/2009 | |
| WO | 2009059410 | A1 | 5/2009 | |

OTHER PUBLICATIONS

International Preliminary Report on Patentability received in PCT/AU2017/051297, 6 pgs.

(56) References Cited

OTHER PUBLICATIONS

Supplementary European Search Report, dated Sep. 23, 2019, issued in corresponding European Application No. 17873996, 3 pages.
International Preliminary Report on Patentability, Ch. II, for PCT/AU2017/051297 dated Mar. 25, 2019 (24 pages).
International Search Report and Written Opinion for PCT/AU2017/051297 dated Mar. 9, 2018 (9 pages).

* cited by examiner

BUILDING PANEL

REFERENCE TO RELATED APPLICATION

The present application claims priority to PCT Application No. PCT/AU2017/051297, filed Nov. 24, 2017, which claims priority to Australian Application No. 2016904863, filed Nov. 26, 2016, the contents of which is incorporated herein by reference in its entirety.

TECHNICAL FIELD

This disclosure relates to a building panel for use in building construction. More particularly, although not exclusively, the building panel can assume a modular format for use in wall, etc. construction. A method of construction using such a panel is also disclosed.

BACKGROUND ART

There is a worldwide need for low cost durable shelters which can be expeditiously constructed without a large input of skilled labour and expensive materials. Such shelters can be required for housing refugees, displaced persons, armed forces, students, etc.

Conventional building construction requires heavy high-cost materials, such as sand, cement, bricks, timber and concrete plus a substantial input of skilled labour. Conventional construction methods can also require many weeks to complete even a basic shelter.

The above references to the background art do not constitute an admission that the art forms part of the common general knowledge of a person of ordinary skill in the art. The above references are also not intended to limit the application of the panel and method as disclosed herein.

SUMMARY OF THE DISCLOSURE

Disclosed herein is a panel for use in construction. The panel may be supplied in a demounted (e.g. flat-packed) form for assembly on site (e.g. to be assembled into a construction unit). Such a construction unit may be employed to form e.g. walls in a building.

The panel comprises opposing surfaces that extend between first and second opposite ends.

The panel also comprises a plurality of parallel ridges provided on at least one of the opposing surfaces. The ridges extend along and adjacent to a first of the opposite ends of the panel for at least a part length thereof. The ridges are arranged to engage with and move past corresponding ridges of an adjacent panel when the panels move relative to each other in opposite directions. The ridges are further arranged so as to interfere with the ridges of the adjacent panel to resist relative movement in a reverse of the opposite direction.

The ridges allow for rapid securing (e.g. locking) together of panels in series (e.g. when in a wall), without the requirement for any other fastening mechanism. For example, when the panels are assembled into the construction unit, they can enable such units to be push- or press-fit together, such as in an end-to-end relationship, to thereby define the wall, etc.

In an embodiment, a plurality of ridges may be provided at each of the opposing surfaces. For example, the plurality of ridges may be provided at a first of the surfaces adjacent to the panel first end, and at a second of the surfaces adjacent to the second panel end.

In an embodiment, the second panel end may be offset but parallel to a plane in which the first and second opposing surfaces of the panel generally lie. The offset may be such that, when the ridges at the second surface of the second end of a second panel are engaged with corresponding ridges at the first surface of the first end of an adjacent and like first panel, the second surface of the second panel may be flush with the second surface of the first panel. This flush joining can define a generally flat surface, such as an externally facing surface of a wall, which surface may subsequently be coated, painted, clad, etc.

In an embodiment, such as when forming the construction unit, a like panel to the first panel may be provided. This like panel may be inverted (e.g. rotated about a central longitudinal axis thereof) such that its parallel ridges at the like panel first end can oppose and face the parallel ridges provided at the first panel first end. Further, the inversion can be such that the parallel ridges at the like panel second end can face outwardly in an opposite direction to the parallel ridges provided at the first panel second end. Thus, the inward facing ridges at one end of e.g. a first construction unit can be secured to outward facing ridges at the other end of e.g. a second construction unit, and so on.

In an embodiment, such as when forming the construction unit, one or more transverse webs may be arranged to extend between and connect the like panel to the first panel in use. Once the web(s) connect the like panel to the first panel, a basic section (i.e. construction unit) has now been defined. When one web only is employed, the section can take the form of an I- or H-profile. However, when two or more spaced webs are employed, the section can take the form of a box section. Such a section may be formed to have desirable structural properties, such as strength, rigidity, toughness, etc. As set forth above, such a section may be constructed on site from demounted (e.g. flat-packed) components. Such a section can also define an internal cavity, which can be left hollow, or which may receive therein a fill material (e.g. concrete, lightweight cementitious material, expanded polymeric foam, insulation material, etc.).

In one variation, the one or more webs may be configured to be releasably connected to and to extend between respective web-engaging formations provided at opposed first surfaces of the first panel and the like panel in use. This releasable connection of the web(s) enables a construction unit to be demounted, packed (e.g. flat-packed), transported, and then e.g. rapidly erected on site. Further, release of the one or more webs from the first panel and the like panel can enable the panels and web(s) to e.g. be flat-packed.

In another variation, the one or more webs may be integrally formed with to connect to and to extend between the opposed first surfaces of the first panel and the like panel in use. This non-releasable connection of the web(s) means that the construction unit is transported in its erected state, and so does not require erection on site. Such an integrally formed unit may have enhanced structural properties, such as increased strength, rigidity, toughness, etc.

In an embodiment, the one or more webs may be releasably connected via respective web-engaging formations. These formations can have a number of different forms. In one variation, they can take the form of one or more slotted clutches. Each clutch can extend for at least part of the length (height-wise in use) of each of the opposed surfaces of the first panel and the like panel. Typically the each clutch extends for a full length of each of the opposed surfaces. The clutches can allow for sliding of each web into place (i.e. to facilitate rapid erection of a construction unit on site).

In an embodiment, the one or more slotted clutches may respectively be provided adjacent to one or both of the plurality of ridges of the first panel and the like panel. In other words, the webs can locate adjacent to the ridges, to provide a degree of rigidity to a resultant construction unit when it is being joined to another construction unit.

In an embodiment, each web may comprise a formation that extends along opposite edges thereof. Each formation may be arranged to be received in a respective slotted clutch to releasably connect that web edge to the panel. The formation (which may take the form of projecting, opposed lips that extend along each edge) can help to facilitate e.g. the sliding or slotting-in of the web edge into a respective slotted clutch. The formation can also releasably connect that web edge to the panel.

In an embodiment, the ridges may have a sawtooth profile when viewed from a side edge of the panel (i.e. when viewed from the side edge that extends between the first and second panel ends). This profile of each sawtooth can be such as to allow relative (e.g. sliding) movement together of adjacent panel ends, to bring adjacent sets of sawtooth ridges into engagement. However, the profile of each sawtooth can be such as to prevent relative (e.g. sliding) movement apart of adjacent panel ends.

In an embodiment, the first and the second opposite ends of the panel may each be defined by a projecting flange. This projecting flange may be defined once the one or webs have been positioned so as to form the construction unit. The ridges may be provided adjacent to a distal edge of each such flange. Further, each such flange may be arranged to deflect in use as the ridges engage with and move past corresponding ridges of an adjacent panel (i.e. when the panels are moved relative to each other in said opposite directions).

Also disclosed herein is a construction unit. The construction unit comprises two opposing panels. Each panel can be as set forth above. The construction unit further comprises one or more transverse webs which are arranged to extend between and connect the two opposing panels in use. Again, each web can be as set forth above.

In use of the construction unit, such as when constructing a wall from like construction units that are to be arranged end-to-end, the ridges that are provided on projecting flanges of the construction units can be arranged such that they deflect in use (i.e. as the ridges at one end of one construction unit engage with and move past the ridges at an opposite end of an adjacent construction unit, such as when the units are moved/pushed relative to each other in opposite directions). More specifically, the ridges that face outwardly at the projecting flanges at one end of one construction unit can be received between the ridges that face inwardly at the projecting flanges at an opposite end of an adjacent construction unit. The resultant inter-engaged ridges on the adjacently located projecting flanges are typically configured such that, once the units have been moved/pushed together, it is extremely difficult, if not impossible, to then separate them (i.e. they are effectively "locked" together and cannot be pulled apart).

Also disclosed herein is a method of construction. The method can employ a plurality of panels, each as set forth above. The method initially comprises forming a construction unit by arranging a first of the panels. The method then comprises arranging a second like panel adjacent to and generally in parallel with the first panel. In this regard, the second panel can be inverted with respect to the first panel (i.e. the second panel can be flipped or rotated around its central longitudinal axis) such that the ridges at the second panel first end are able to oppose and face the ridges at the first panel first end. Further, when so inverted, the ridges at the second panel second end face outwardly in an opposite direction to the ridges at the first panel second end.

The method can then comprise arranging one or more webs to extend between and connect the first and second panels via their opposing first surfaces. Once the web(s) are so arranged the construction unit is defined. Thus, the method can make use of demounted (e.g. flat-packed) components.

The method of forming such a construction unit is rapid. Multiple such units can be formed at e.g. a construction site, ready to then be deployed into a building (e.g. wall). Such units may even be formed at the wall itself.

In an embodiment of the method, two spaced webs may be arranged to extend between and connect the first and second panels via their opposing first surfaces. This can define the construction unit as a box section (box profile). Such a section can have enhanced structural properties, such as increased strength, rigidity, toughness, torsional resistance, etc. As above, such a section may receive therein a fill material (e.g. concrete, lightweight cementitious material, expanded polymeric foam, insulation material, etc.).

In one variation of the method, the one or more webs may be slidably mounted into place to releasably connect to and to extend between respective web-engaging formations provided at the opposed first surfaces of the first and second panels. As set forth above, this slide-fitting can facilitate rapid erection of a construction unit on site.

In another variation of the method, the one or more webs may be integrally formed with so as to connect to and to extend between respective opposed first surfaces of the first and second panels. Thus, the method of construction can make use of a pre-formed construction unit, with no ability to flat-pack, but with no need to build the unit on site.

In an embodiment of the method, like construction units may be joined together end-to-end to form a wall section. This joining can occur by bringing into engagement the ridges located at each of the first ends of the first and the second panels of a first construction unit, with corresponding ridges located at the second ends of the respective first and the second panels of a like construction unit.

In an embodiment, the method may further comprise providing a post section. The post section may itself be formed form a number of components to be demountable (e.g. to be disassembled for packing such as flat-packing, storage, transportation, erection on site, etc.). The post section can act as a corner unit, pillar, joiner unit, etc.

In an embodiment, the method may further comprise arranging the post section for location at the end of one, or at the end of a series of construction units that have been joined together end-to-end. The post section may comprise opposing parallel flanges that project from a side of the post section. Each flange may comprise a plurality of corresponding ridges (e.g. such as sawtooth ridges). The corresponding ridges can be arranged to engage with the ridges (e.g. such as sawtooth ridges) at either the first end or second end of a respective panel of the construction unit. In other words, the post section can be formed to have the same joining mechanism as each construction unit.

In an embodiment of the method, first opposing and parallel flanges may project from one side of the post section and second opposing and parallel flanges may project from another side of the post section. The first flanges may extend in a different direction to the second flanges.

For example, in one form of the post section the first flanges may project orthogonally from the post section with respect to the second flanges. This can define the post section as a corner section.

In another form of the post section the first flanges may project from an opposite side of the post section to the second flanges. This can define the post section as a two-way joiner section.

In a further form of the post section the first flanges may project from an opposite side of the post section to the second flanges. Additionally, opposing and parallel third flanges may project orthogonally from a side of the post section (i.e. to project with respect to the first and the second flanges). This can define the post section as a three-way joiner section.

In yet a further form of the post section the first flanges may project from an opposite side of the post section to the second flanges. Additionally, opposing and parallel fourth flanges may project orthogonally from a side of the post section located with respect to the first and the second flanges. Further, the fourth flanges may project in an opposite direction to the third flanges. This can define the post section as a four-way joiner section.

In an embodiment of the method, a plurality of construction units may be arranged to define a partially enclosed structure (e.g. to define one or more walls of the structure). Further, a plurality of post sections may be arranged together with the construction units to define the structure. Several of the above forms of the post section may be assembled and deployed, depending on the design and type of structure to be erected.

In an embodiment, the method may further comprise arranging a cap at an in-use upper end of the post section. The cap may be arranged to receive a tensioning rod therethrough in use. When arranged at the upper end of the post section in use, the cap together with the tensioning rod can enable a compression force to be applied to the cap, and thus to the post section.

In one embodiment, the cap may comprise a hollow that defines a recessed base within the cap. The recessed base may be provided with an aperture therethrough. The aperture can be arranged to receive the post tensioning rod therethrough in use. A fastener (e.g. a nut, internally threaded hollow bolt, etc.) can then be deployed on the post tensioning rod (e.g. on an external thread thereof), with the fastener caused to bear down on the recessed base to apply the compression force to the cap and thus to the post section.

In one embodiment, the cap may further comprise one or more cap flanges. The cap flanges may be arranged at an in-use upper periphery of the cap, and may be arranged to extend downwardly in-use. Each cap flange may be further arranged to locate between respective post section flanges when present. Each cap flange may be further arranged to locate adjacent to a respective side of the post section. Thus, the cap may be configured to be press-, push- or interference-fit into an open upper end of the post section in use.

In one embodiment, a sealing element may be arranged intermediate the cap and an upper end of the post section. The sealing element may be an elastomer or other type of deformable gasket, and may be adapted to deform under compression so as to conform to, and create a seal between, the cap and the post section upper end. The sealing element can function to prevent water ingress into a structure via the cap and post section joint.

In an embodiment of the method, prior to arranging the construction units and post sections to define the structure, a channel section that is upwardly open in use may be provided at a base of the structure (e.g. the channel section may be affixed to a floor of the structure). The channel section may define a base plate of a respective wall of the structure. The channel section may be dimensioned such that an in-use lower region of each of one or more construction units and/or post sections can locate within the channel section (e.g. snugly therein to be supported thereby).

In an embodiment of the method, a plurality of first (or base plate) channel sections may be arranged at (e.g. affixed to) a floor panel of the structure. Each channel section can define a base plate for a respective wall of the structure.

In an embodiment of the method, a plurality of second (or top plate) channel sections may be arranged to receive and locate an in-use upper region of each of one or more construction units of the structure. Each second channel section can define a top plate of a respective wall of the structure. For simplicity, the first and second channel sections may comprise the same profile, but a profile that is simply inverted depending on whether it forms the base plate or top plate.

In an embodiment of the method, an end of each first channel section may be arranged to lie adjacent to and to abut a respective post section (typically a corner post section). A lower end of intermediate and joiner post sections may sit within a respective first channel section. To enable each post section (i.e. that locates adjacent to a first channel section end) to be generally level with an adjacent construction unit, a support plate may be arranged under each such post section. The support plate can sit adjacent to each first channel section end, so as to be level with a web of each first channel section. When the post section is used with a tensioning rod, the support plate can have an aperture therethrough, and through which the tensioning rod can extend.

In an embodiment of the method, an end of each second channel section may be arranged to lie over a respective post section (typically a corner post section, and so that each second channel section can overlie the cap located therein). An upper end of intermediate and joiner post sections may sit within a respective second channel section. For example, if adjacent second channel sections come together to overlie a corner post section, they may be cut (e.g. in a mitre-joint) so as to abut each other overlying the corner post section.

In an embodiment of the method, a floor panel may be located at a floor bearer assembly. One or more discrete, spaced additional tensioning rods may be provided intermediate the post sections. Each intermediate rod may extend from the floor bearer assembly, through a base plate, through a construction unit, and through a top plate. Thus, when each intermediate rod is tensioned in use, this can draw the base and top plates together to thereby apply a compressive retention force to the one or more construction units located therebetween. In this regard, a suitable fastener (e.g. nut, internally threaded bolt, etc.) may be provided for each intermediate tensioning rod. This fastener can be configured such that it can be caused to bear down on the top plate to apply said compression force. In this way, a very strong, stable and robust wall, etc. can be constructed by the method. When e.g. a cementitious is filled into each unit, such material may bind with and be reinforced by each intermediate tensioning rod.

In an embodiment of the method, the floor bearer assembly may comprise a plurality of elongate bearer elements. Each such bearer element may be formed to have a plurality of elongate hollow channels therethrough (i.e. so as to have a type of honeycomb profile). In an embodiment, adjacent bearer elements at a corner may be joined to each other via a bearer corner component (e.g. a component that is interferingly received in one of the elongate hollow channels of each adjacent bearer element at the corner). The bearer corner component may also enhance the structural properties of the resultant floor bearer assembly, such as by providing increased strength, rigidity, etc.

In an embodiment of the method, the floor panel of the structure may be configured such that it is also able to function as a roof panel of the structure. This roof panel may be arranged adjacent to the top plate(s) of respective wall(s) of the structure. Again, this can simplify overall construction.

In an embodiment of the construction method, a further storey of the structure may be constructed. In this regard, a bearer assembly may be arranged at the roof panel. The bearer assembly may comprise first and second like elongate bearer elements. The second of the bearer elements may be inverted with respect to, so as to be arranged underneath and to face, the first of the bearer elements in use.

Each first and second elongate bearer element may be configured to define an elongate channel that extends for its length. Thus, the method of arranging the bearer assembly at the roof panel may further comprise arranging an elongate interconnection (i.e. interlocking) member to locate between and to connect the first and the second elongate bearer elements. This can define the bearer assembly as a unit to further enhance the structural properties of the resultant floor bearer assembly for the further storey. Additionally, this interconnection member may be dimensioned such that it is able to locate and extend (e.g. snugly or interferingly) within the elongate channels of the first and second elongate bearer elements.

When constructing the further storey of the structure, a floor panel for the further storey may be arranged at the bearer assembly. Additionally, one or more channel sections may be arranged as base plates at the floor panel of the further storey. Further, one or more further construction units may be arranged at the base plates. Yet further, one or more channel sections as top plates for the further storey may be arranged along and on top of the one or more further construction units.

Also disclosed herein is panel kit for use in construction. The kit comprises at least two panels. Each panel may be as set forth above. The kit further comprises at least one web. Each web may be as set forth above. In the kit, the panels and the web(s) can be adapted for dismantling to enable the panels and the web(s) to be flat-packed.

The kit may further comprise one or more of the post sections as set forth above. Again, the post section(s) may be adapted for dismantling to enable them to be flat-packed along with the panels and the web(s). The kit may further comprise each of the other components as set forth above, including but not limited to the post section cap(s), tensioning rod(s), channel(s), support plate(s), floor and roof panel(s), bearer assembly component(s), bearer corner component(s), etc.

BRIEF DESCRIPTION OF THE DRAWINGS

Embodiments will now be described by way of example only, with reference to the accompanying drawings in which.

DETAILED DESCRIPTION OF SPECIFIC EMBODIMENTS

Figure 1:
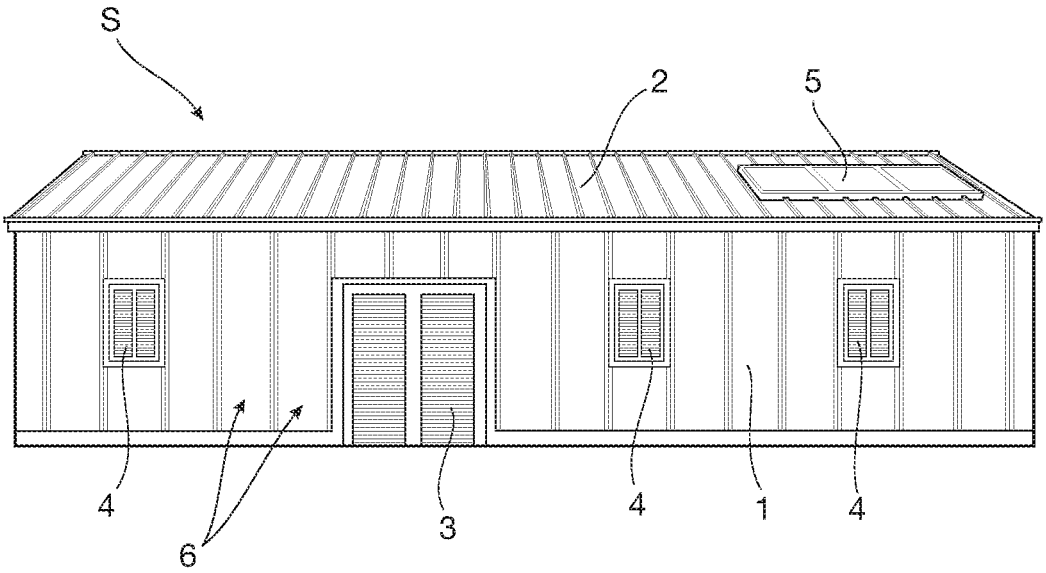
FIG. 1 is a front schematic (perspective) view of a basic modular building in accordance with a first embodiment.

In the following detailed description, reference is made to accompanying drawings which form a part of the detailed description. The illustrative embodiments described in the detailed description, depicted in the drawings and defined in the claims, are not intended to be limiting. Other embodiments may be utilised and other changes may be made without departing from the spirit or scope of the subject matter presented. It will be readily understood that the aspects of the present disclosure, as generally described herein and illustrated in the drawings can be arranged, substituted, combined, separated and designed in a wide variety of different configurations, all of which are contemplated in this disclosure.

Figure 1A:
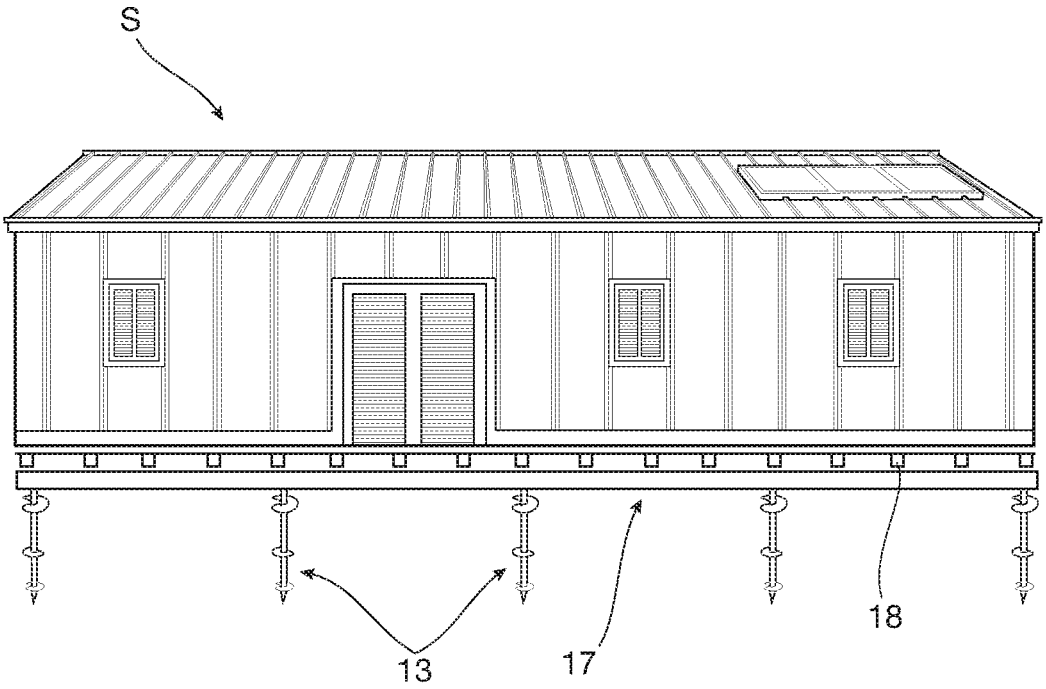
FIG. 1A is a similar front schematic (perspective) view to FIG. 1, but showing a foundation and floor bearing assembly.

Referring firstly to FIGS. 1 and 1A, a basic modular building is shown in the form of a shelter S. The shelter S may be of a type that can be erected for low cost housing (e.g. housing for refugees or other displaced persons, persons in remote locations, etc.). However, it should be understood that a range of buildings may be constructed using the components and methodologies as disclosed herein. For example, FIG. 1B shows a basic modular building in the form of a shed or garage G.

The shelter S of FIGS. 1 and 1A comprises a front wall 1, a flat typically sloped roof 2, an entry door 3, windows 4, skylights 5 and wall panels 6. The shelter S of FIG. 1A is also shown as comprising a series of screw piles 13, which support a floor bearer 17, which in turn supports a floor panel 18 of the structure S.

Figure 1B:
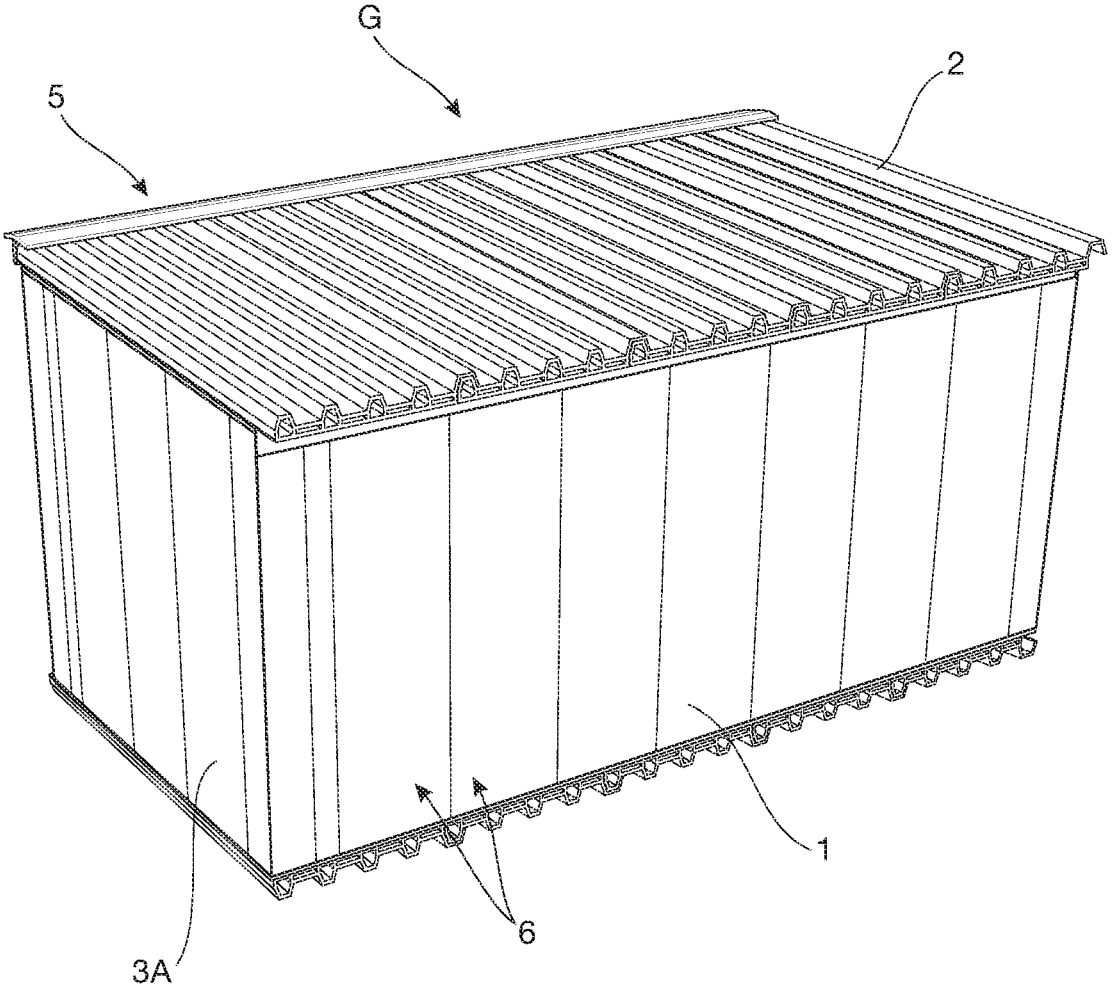
FIG. 1B is a schematic (perspective) view of a basic modular building in accordance with a second embodiment.

The shed/garage G of FIG. 1B comprises a front wall 1, a flat typically sloped roof 2, side walls 3A, skylight 5 and wall panels 6.

Figure 2:
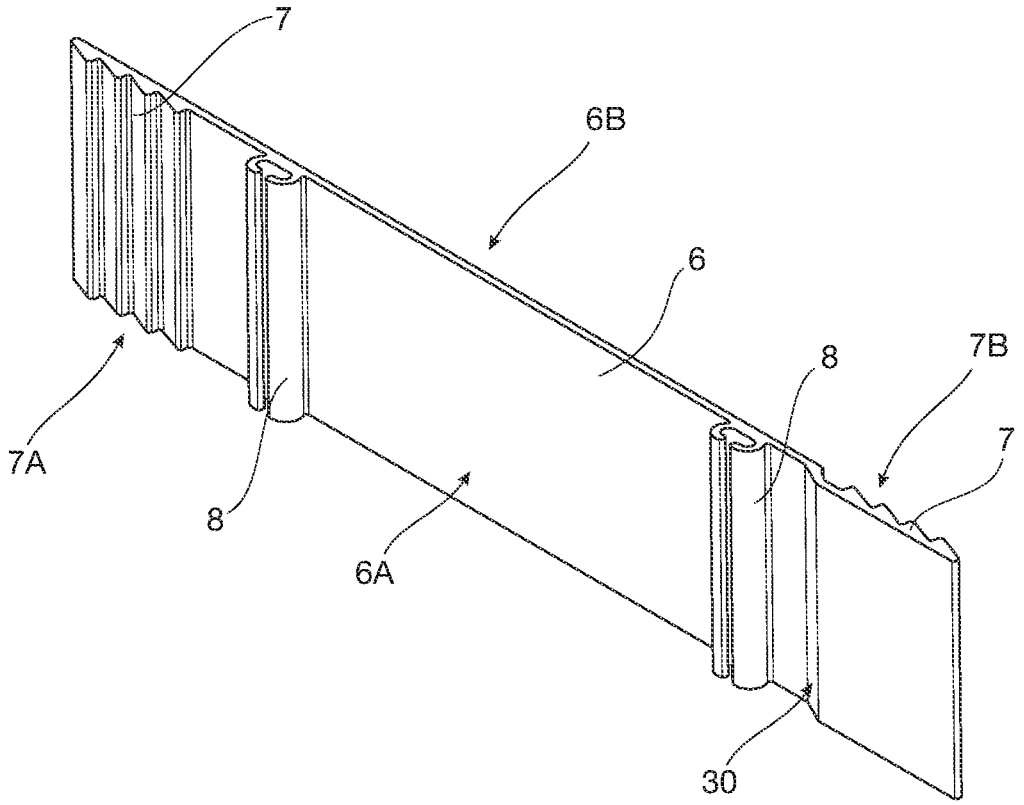
FIGS. 2 and 2A respectively show perspective and plan schematic views of a building panel in accordance with a first embodiment.

One example of a modular panel 6 used to construct the walls of the shelter S or shed or garage G is shown in FIG. 2. The panels 6 and other components of the shelter S or shed/garage G can be adapted for flat-packing. The panels, etc. can be prefabricated from a fibre reinforced polymer such as (but not limited to) vinyl ester, PVC, etc. The panels may be formed using a Pultrusion process. It should also be understood that the panel 6 as shown in FIG. 2 may be separately deployed in internal wall construction, etc. along with conventional construction methods and materials.

Referring now to FIG. 2, a given panel 6 has opposing surfaces 6A and 6B. In a simple panel format, at least one of opposing surfaces 6A and 6B can be provided with a plurality of parallel ridges in the form of sawtooth connecting ridges 7. In another simple panel format, the sawtooth ridges 7 can extend at just one panel end, and for a part length of the panel end.

However, in the panel 6 of FIG. 2, the sawtooth ridges 7 are located at one end 7A of surface 6A and at an opposite end 7B of surface 6B. Each set of sawtooth flanges 7 extends for a full length of that end. In addition, the sawtooth ridges at ends 7A and 7B are on opposite sides and hence face in opposite directions as shown.

As will be explained hereafter, the sawtooth ridges 7 at one end of the panel are arranged to engage with and move past corresponding sawtooth ridges of an adjacent (e.g. alike) panel when the panels are moved relative to each other in opposite directions. For example, the sawtooth ridges 7 at end 7A of a first panel can engage with and move past corresponding sawtooth ridges 7 at end 7B of an adjacent second panel.

Additionally, the profiling of the sawtooth ridges 7 is such that they interfere with the sawtooth ridges of the adjacent (e.g. alike) panel to resist relative movement in a reverse of this opposite direction. This configuring of the sawtooth ridges 7 at the ends of adjacent panels allows the panels to be secured (e.g. locked) together in use, as will be explained hereafter.

Figure 2A:
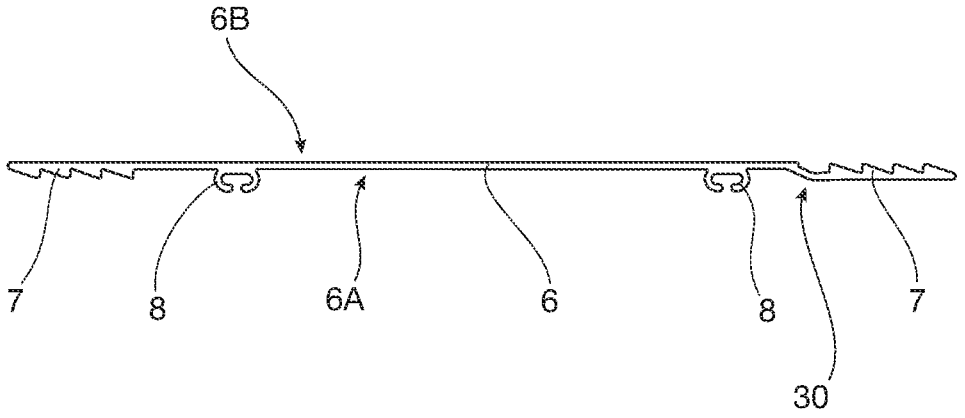

In the panel 6, and as best shown in FIG. 2A, the panel end 7B is offset but parallel to a general plane in which the surfaces 6A and 6B of the panel lie. In this regard, a step 30 is formed in the panel 6 so as to laterally shift the plane of panel end 7B relative to a remainder of the panel. Thus, in use, when the sawtooth ridges 7 at the surface 6B of a second panel end 7B are engaged with corresponding sawtooth ridges 7 at the surface 6A of an adjacent first panel end 7A, the surface 6B of the second panel is able to be flush with the corresponding surface 6B of the first panel. In use, this means that a generally flat (e.g. outer surface) of a resultant wall can be formed. In this regard, reference is specifically made to FIG. 3A. Such a wall can be coated, painted, clad, etc.

Figure 3:
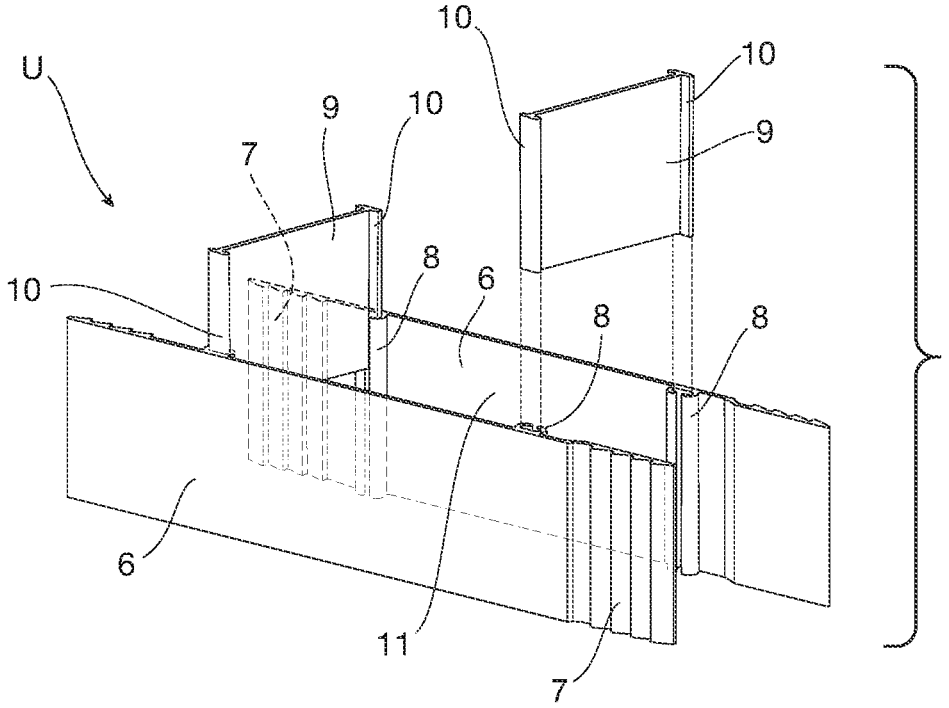
FIG. 3 is a perspective view showing the assembly of a pair of like building panels according to FIGS. 2 and 2A to form a basic construction unit for use in e.g. a wall structure.
Figure 3A:
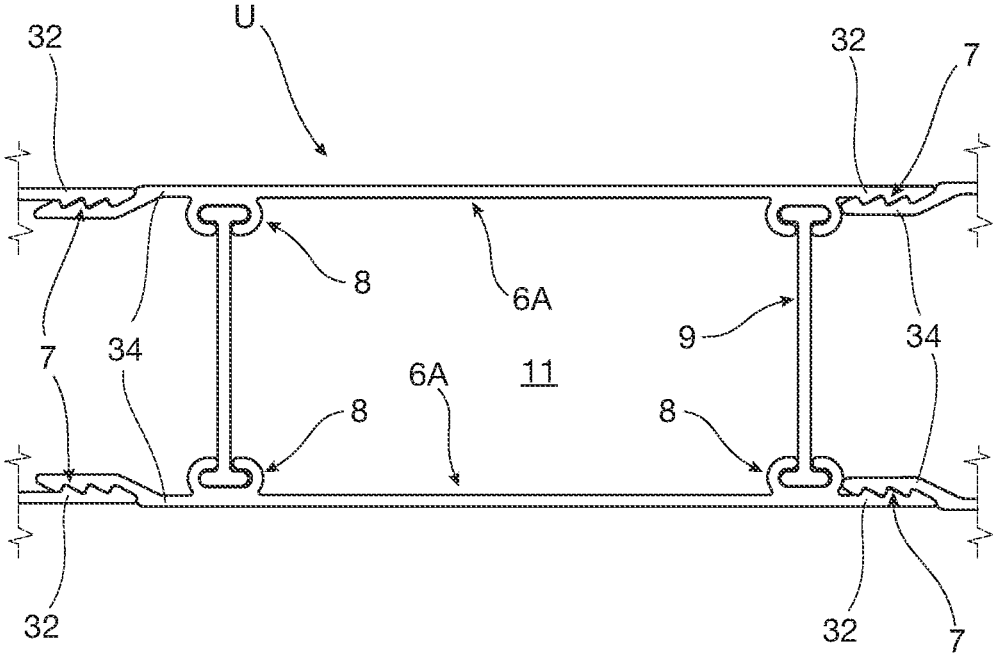
FIG. 3A is a plan view of the resultant construction unit of FIG. 3.
Figure 3B:
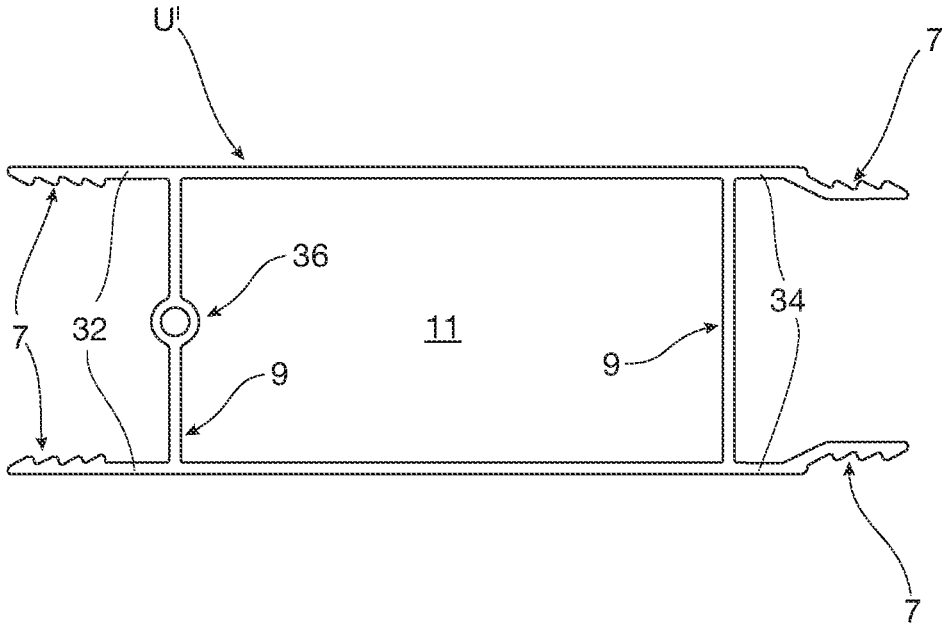
FIG. 3B is a plan view of an alternative (integrally formed) construction unit to that of FIGS. 3 and 3A.

As will be explained in further detail hereafter, the panel 6 can be used to form a construction unit U. Such a unit can be a demountable (e.g. a flat-packable) unit U, such as is shown in FIGS. 3 and 3A. Alternatively, the panel 6 may be integrated into (i.e. it may be integrally formed as part of) a construction unit U', such as is shown in FIG. 3B. These units U and U' can be employed interchangeably when constructing a building, such as shelter S or shed/garage G.

In the demountable (e.g. a flat-packable) construction unit U of FIGS. 3 and 3A, a like panel 6 to the panel 6 of FIG. 2 is provided. This like panel is able to be (and is shown in the drawings as having been) inverted. By "inverted" it is meant here that the like panel has been rotated about its central longitudinal axis. Once so inverted, the like panel is arranged in parallel to the panel 6 of FIG. 2. When so arranged, the sawtooth ridges 7 at the like panel first end 7A are able to oppose and face the sawtooth ridges 7 at the first panel first end 7A. Further, the sawtooth ridges 7 at the like panel second end 7B face outwardly and in an opposite direction to the sawtooth ridges 7 provided at the first panel second end 7B.

This same arrangement of sawtooth ridges 7 is duplicated in the integrally formed construction unit U' of FIG. 3B.

As shown in FIGS. 3A and 3B, with either of the construction units U, U', the first ends 7A of the panels define projecting flanges 32 and the second opposite ends 7B of the panels define projecting flanges 34. The sawtooth ridges 7 are thus provided adjacent to a distal edge of each of the projecting flanges 32, 34.

Figure 4:
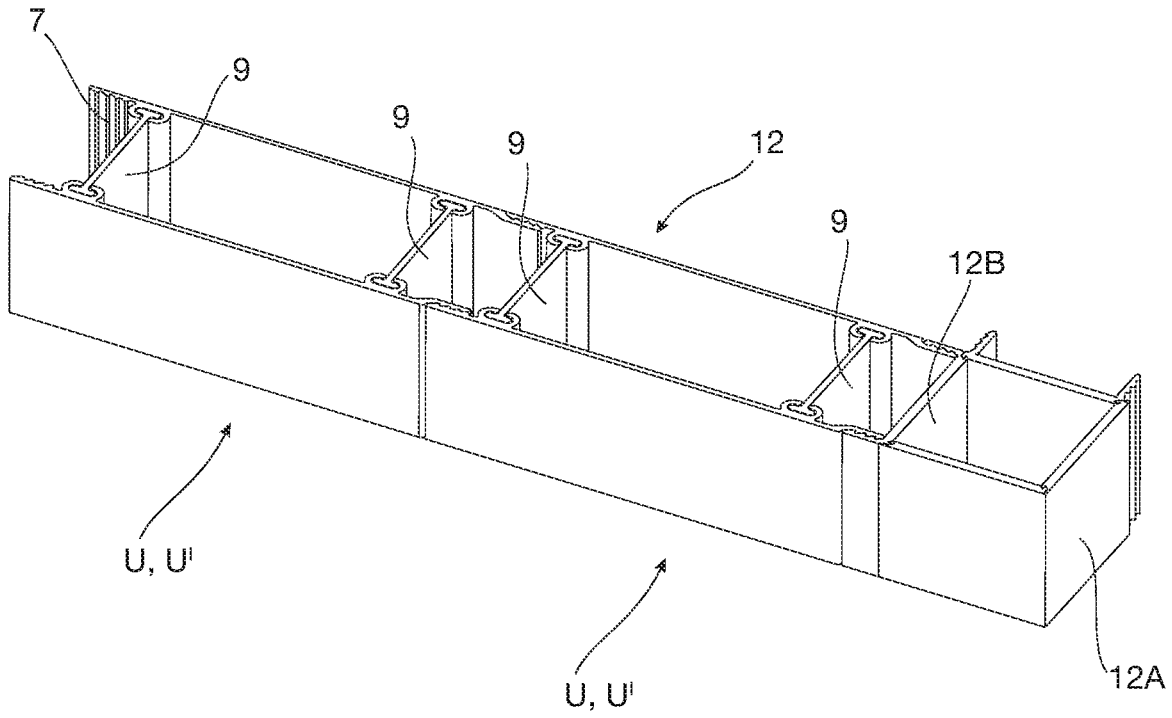
FIG. 4 is a perspective view showing the assembly of two construction units of either FIG. 3/3A or 3B in an end-to-end configuration, along with a corner unit arranged at one end, the assembly for use as e.g. a wall structure.
Figure 6:
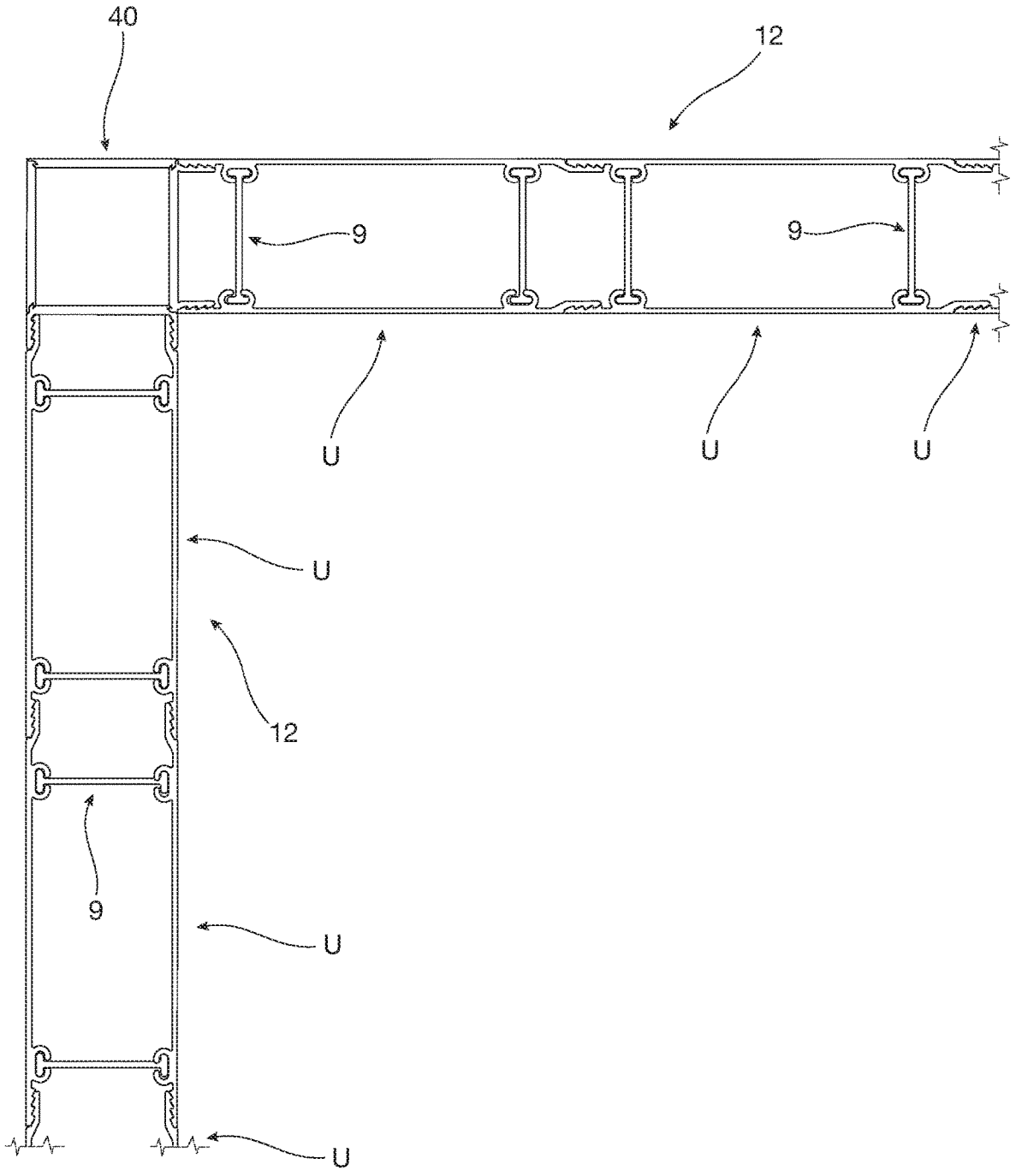
FIG. 6 is a plan view showing the assembly of multiple of the construction units of FIGS. 3/3A arranged in an end-to-end configuration, the assembly defining e.g. two wall structures that converge at a corner unit.

FIGS. 4 and 6 illustrate specific uses of the construction units U, U', such as when constructing one or more walls from like construction units that are arranged end-to-end. In use, each of the projecting flanges 32, 34 is arranged to deflect in use as the sawtooth ridges 7 at one end of one construction unit engage with and move past the sawtooth ridges 7 at an opposite end of an adjacent construction unit (i.e. when the units are moved/pushed relative towards each other in opposite directions). More specifically, the sawtooth ridges 7 that face outwardly at the projecting flanges 34 at one end of one construction unit are received between the sawtooth ridges 7 that face inwardly at the projecting flanges 32 at an opposite end of an adjacent construction unit. The resultant fully inter-engaged sawtooth ridges 7 on the adjacently located projecting flanges 32 and 34 are such that, once the units have been fully moved/pushed together, it is extremely difficult, if not impossible, to then separate them (i.e. they are effectively "locked" together and cannot be pulled apart). This locking together of construction units enhances the structural properties of the resultant wall, providing the wall with increased strength, rigidity, toughness, etc. Also, there is no need for separate fasteners to secure the construction units together.

Each construction unit U, U' further comprises one or more transverse webs 9 which are arranged in use to extend between and to connect a first panel to a like panel in use. In the embodiments disclosed herein, two such webs 9 are shown in each construction unit U & U', although it is possible that a single web could be provided to define a construction unit having an H- or I-type profile, or longer construction units can be formed that possess three or more webs.

In the construction unit U of FIGS. 3 and 3A, the webs 9 are configured to be releasably connected to and to extend between respective web-engaging formations provided at opposed first surfaces 6A of the first panel and the like inverted panel in use. In FIGS. 2, 2A, 3 and 3A, the web-engaging formations take the form of one or more slotted clutches 8, although other types of joining mechanisms are envisaged. Each clutch 8 is located adjacent to a respective arrangement of sawtooth ridges 7. Whilst the clutches 8 can extend for a part length (i.e. height) of each of the opposed surfaces 6A, typically they extend for the full length thereof.

Figure 5:
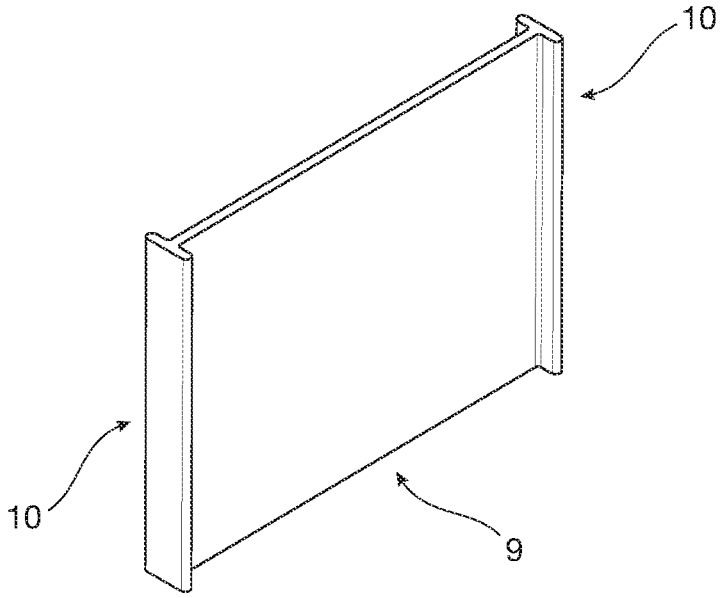
FIG. 5 is a perspective view of a removable web for use with the building panels of FIGS. 3 and 3A when forming a construction unit for use in e.g. a wall structure.

As shown clearly in FIG. 5, each web 9 comprises lip formations 10 that extend along opposite edges thereof, and that project out from each side of a given edge. Each lip formation 10 is configured so as to be snugly received in (e.g. in a slidable manner into) a respective slotted clutch 8 to releasably but securely connect that web edge 10 to a respective panel 6. This sliding engagement to form the construction unit U is best illustrated by FIG. 3. This arrangement allows the construction unit U to be supplied dismantled/demounted and flat-packed for storage, transport, etc., but to then be erected on site.

In the construction unit U' of FIG. 3B, the webs 9 are integrally formed with to connect to and to extend between the opposed first surfaces 6A of the first panel 6 and the like panel 6 in use. Thus, in the construction unit U' of FIG. 3B, the panels 6 and webs 9 do not exist independently of the unit. FIG. 3B also shows that one of the webs 9 comprises an integrally formed conduit 36 extending for its length. This conduit is able to receive an intermediate tensioning rod 21*i* therethrough, as will be described in further detail hereafter.

To assemble a wall of the shelter S or shed/garage G, pairs of panels 6 are first arranged in parallel relationship with the clutches 8 facing inwards, such as is shown in FIGS. 2, 3, 4 and 6. The transverse webs (or spines) 9 are then inserted between the panels 6, so that the lip formations 10 of the webs 9 slidably engage with each set of facing clutches 8. The opposing panels 6, together with the webs 9, form the construction unit U as a rigid box section. Each box section thereby defines an internal cavity 11. This cavity 11 can be left hollow, or may receive therein a fill material (such as concrete, lightweight cementitious material, expanded polymeric foam, insulation material, etc.). The resultant rigid and strong construction unit U, U' is now ready to engage and lock end-to-end with other like units U, U'. This locking end-to-end forms a length of wall structure 12 as shown in FIGS. 4 and 6.

Referring now to FIGS. 7A to 7E, embodiments of a post section are shown in the form of a demountable corner (or end) unit 40 for use with the construction units U, U'. Just like the construction unit U, the corner unit 40 can be supplied in a dismantled (demounted) format to be flat-packed for storage, transport, etc., and to be erected on site. Because it is demountable, and is formed from a number of components, the corner unit 40 can also be reconfigured to take the form of an intermediate post (e.g. that joins two wall sections in line, each formed from one or more of the construction units U, U'). Additionally, the corner unit 40 can be reconfigured to take the form of a 3-way junction post or a 4-way junction post.

Figure 7A:
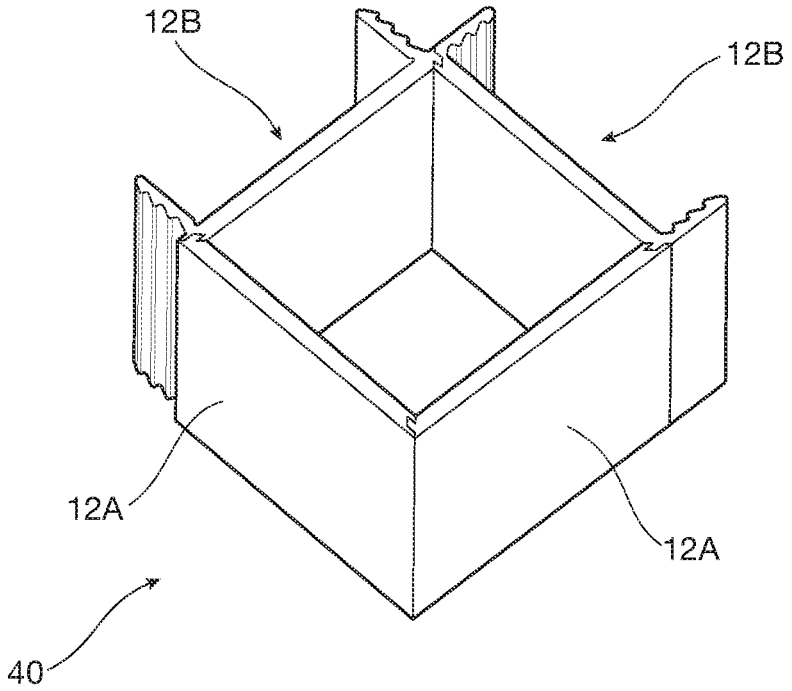
FIGS. 7A and 7B are perspective views from alternative orientations showing an assembled and part-assembled corner unit for use with the wall structures of FIGS. 4 and 6.
Figure 7B:
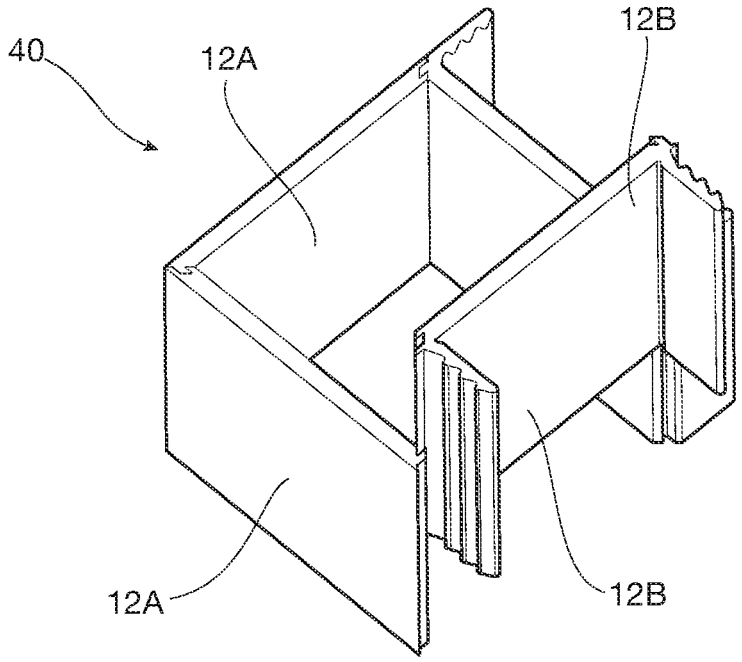

When assembled, the demountable corner unit 40 defines a profile that is formed by specially shaped outer panels 12A along with web spines 12B and 12C which together can slidably engage (as indicated by FIG. 7B) to define the corner unit 40 to have an elongate hollow profile. In this regard, the side edges of the panels 12A and corner edges of the web spines 12B and 12C comprises tongue- and groove-type formations 41 (see FIG. 7C) that slide and mate together.

Figure 7C:
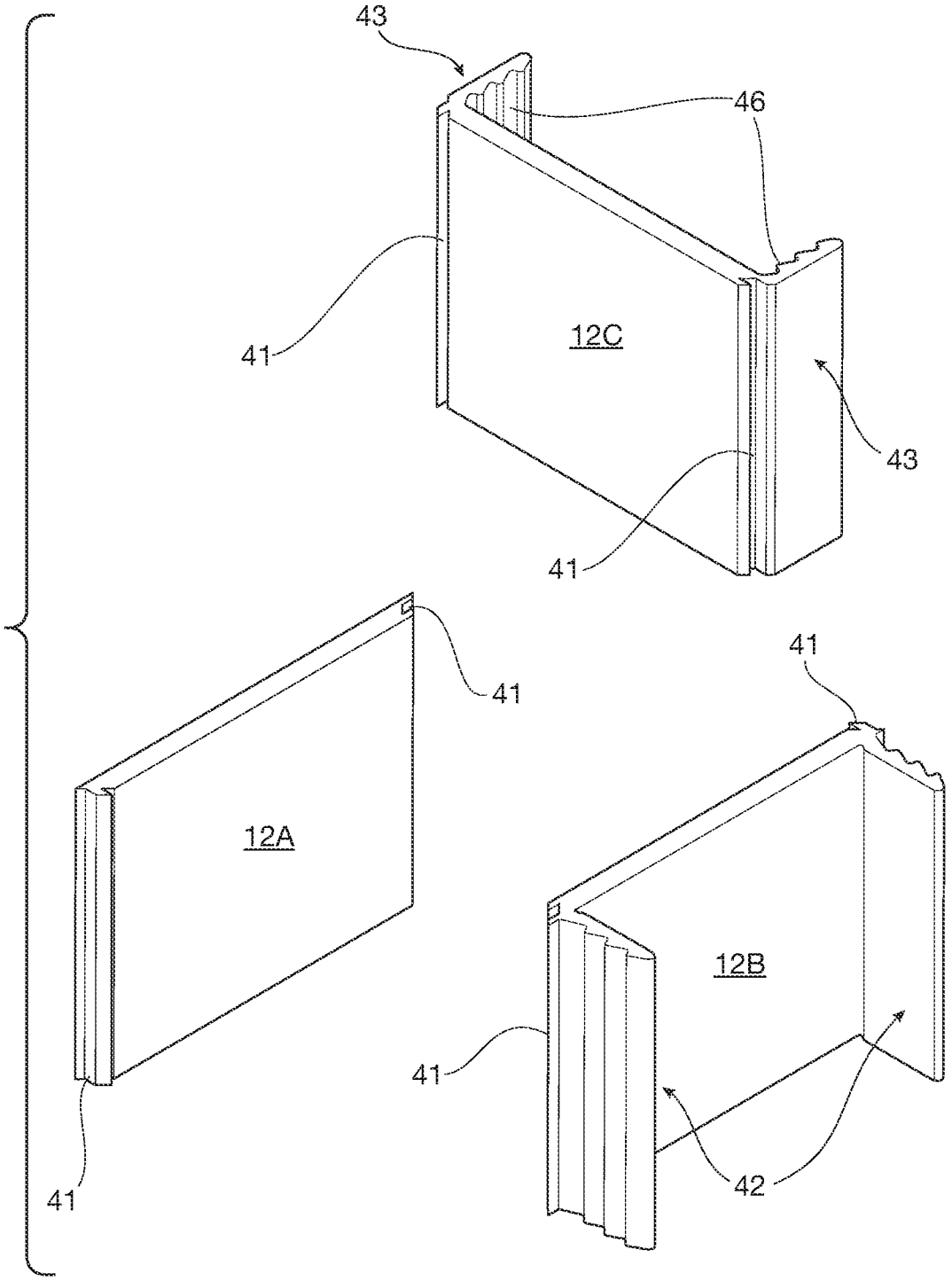
FIG. 7C is a disassembled perspective view of the corner unit of FIG. 7A.
Figure 7D:
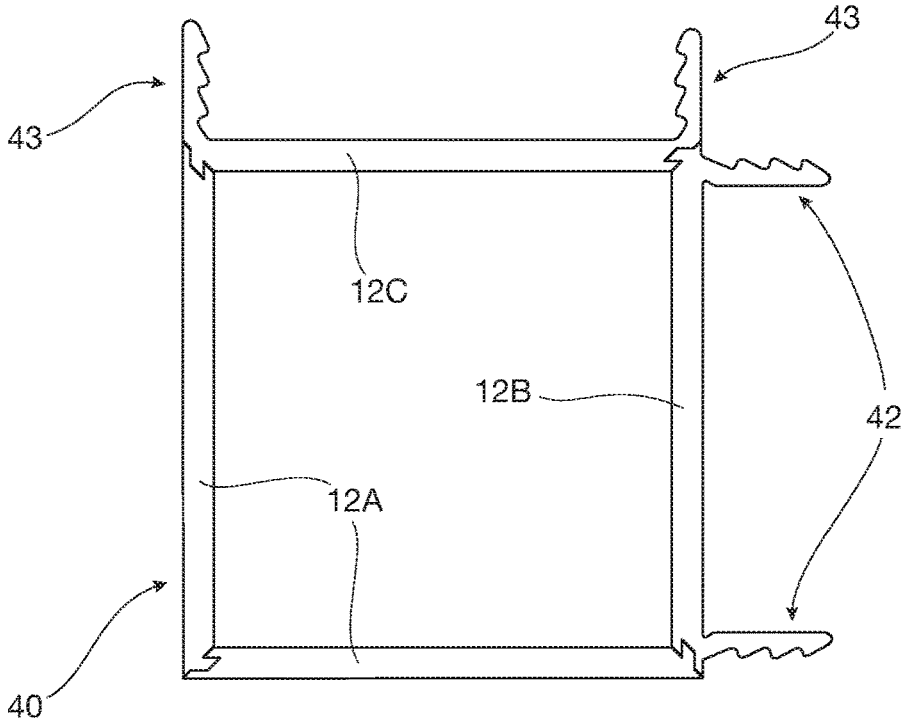
FIG. 7D is a plan view of the assembled corner unit of FIG. 7A.
Figure 7E:
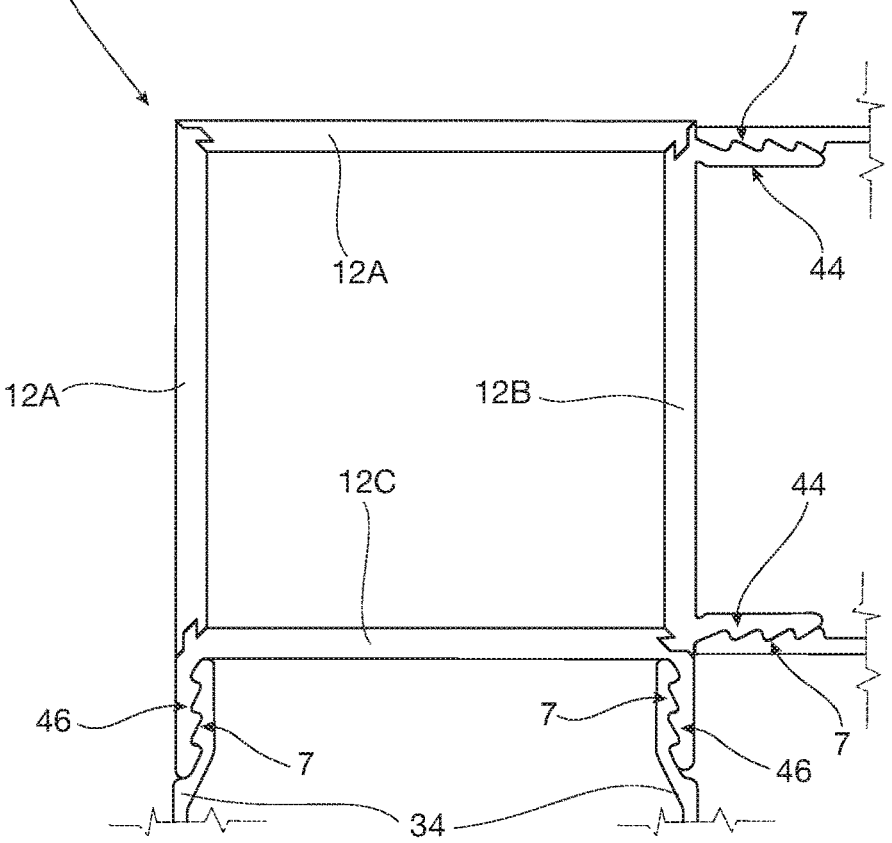
FIG. 7E is a plan view of the assembled corner unit when connected to the flanges of adjacent construction units.

The web spines 12B and 12C each have a pair of forward flanges 42 and 43 respectively that project from two adjacent edges thereof. As best shown in FIG. 7C, the forward flanges 42 of web spine 12B comprise sawtooth ridges 44 on outward facing surfaces thereof, whereas the forward flanges 43 of web spine 12C comprise sawtooth ridges 46 on inward facing surfaces thereof. As shown in FIGS. 6 and 7E, the configuration of the web spine 12B enables its respective sawtooth ridges 44 to inter-engage and lock with the sawtooth ridges 7 located on the projecting flanges 34 of an adjacent construction unit. Likewise, the configuration of the web spine 12C enables its respective sawtooth ridges 46 to inter-engage and lock with the sawtooth ridges 7 located on the projecting flanges 34 of an adjacent construction unit.

Figure 7F:
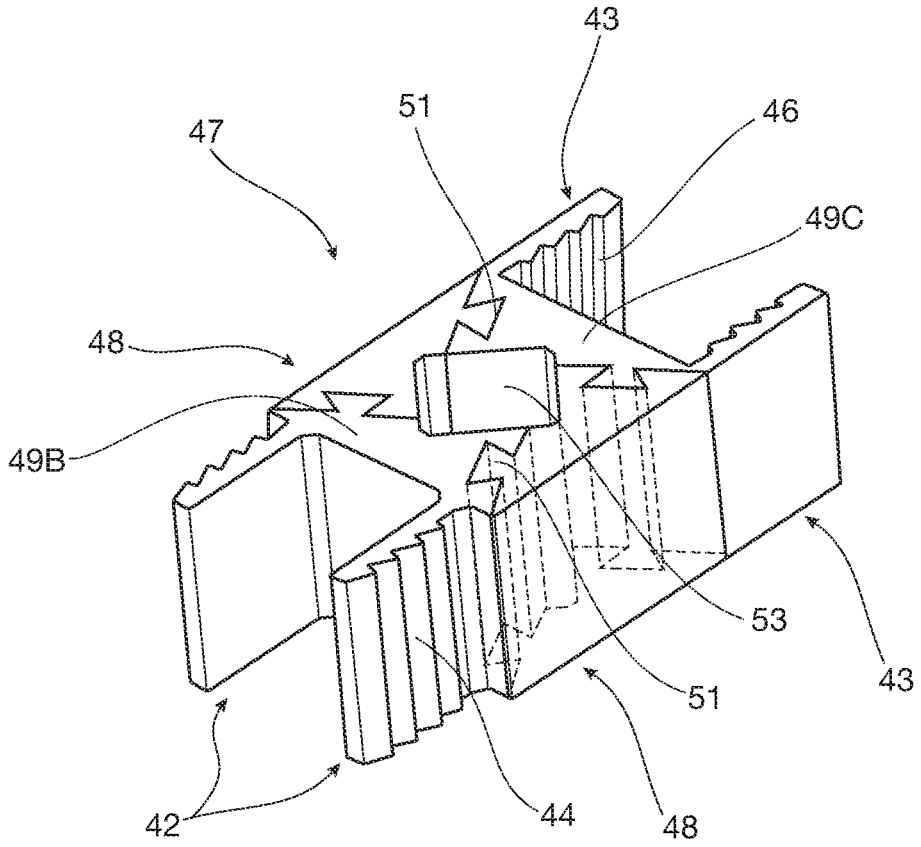
FIG. 7F is a perspective view of an alternative intermediate joiner post embodiment for joining adjacent construction units, such as those shown in FIG. 6.

When the corner unit 40 is reconfigured as an intermediate post, the forward flanges 42 and 43 project in opposite directions (i.e. from opposite sides of the post). In this regard, reference is now made to FIG. 7F which shows an alternative embodiment of an intermediate joiner post 47.

The intermediate joiner post 47 of FIG. 7F is again demountable and defines a profile that is modified over the corner unit 40. In this regard, the outer panels 48 have a triangular profile, as do the spines 49B and 49C. The spine 49B comprises the projecting flanges 42 having sawtooth ridges 44 formed on an outwardly facing surface, whereas the spine 49C comprises the projecting flanges 43 having sawtooth ridges 46 formed on an inwardly facing surface. Further, the panels 48 and spines 49 can slidably engage by virtue of tongue and groove formations 51. When engaged, the panels 48 and spines 49 define a generally square bore 53 through the intermediate joiner post 47. The bore 53 can receive an intermediate tensioning rod 21*i* therethrough, as described below.

When the corner unit 40 is reconfigured as a 3-way junction post, the forward flanges 42 and 43 project in opposite directions, and a further web spine is provided (in place of one of the panels 12A) with a pair of forward flanges that project orthogonally to the forward flanges 42 and 43, from an intermediate side of the post. When the corner unit 40 is reconfigured as a 4-way junction post (see e.g. FIG. 8C), another additional web spine is provided with a pair of forward flanges that project orthogonally to the forward flanges 42 and 43, but from an opposite intermediate side of the post.

Referring now to FIGS. 8A to 8E, two components for use with the corner (or end) unit 40 are shown. The first component, shown in perspective view in FIG. 8A, in partly-sectioned view in FIG. 8B, and in plan view in FIG. 8C, comprises a top cap 50 for location in an open upper end of the corner unit 40. The cap 50 is provided so that the corner unit 40 is able to receive a tensioning rod 21 therethrough in use, and so that a compression force can be applied to the cap 50 (and thus to the corner unit 40) when the cap is arranged at the upper end of the post section in use.

In this regard, the cap 50 comprises a truncated inverted pyramidal hollow 52 that defines a recessed base 54 within the cap. The recessed base is provided with an aperture 56 therethrough, the aperture arranged to receive the tensioning rod 21 therethrough in use. This enables a fastener (e.g. a nut, internally threaded bolt, etc.) to be driven down on the tensioning rod 21, such that the fastener is caused to bear down on the recessed base 54 to apply the compression force thereto (which force is thus translated to the upper end of the corner unit 40).

Figure 8A:
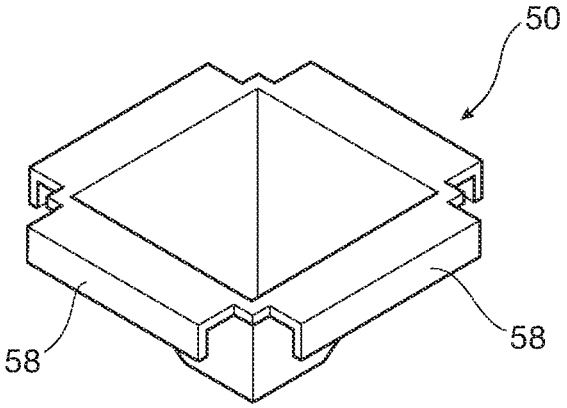
FIGS. 8A to 8D respectively show: perspective; part-sectioned side; in-use plan; and in-use perspective views a cap for use with an assembled corner unit; with FIG. 8E showing a corner unit embodiment and a support plate for that corner unit.
Figure 8D:
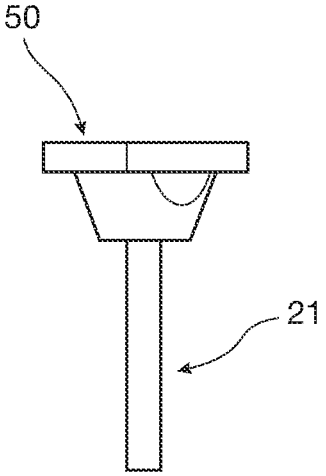
Figure 8B:
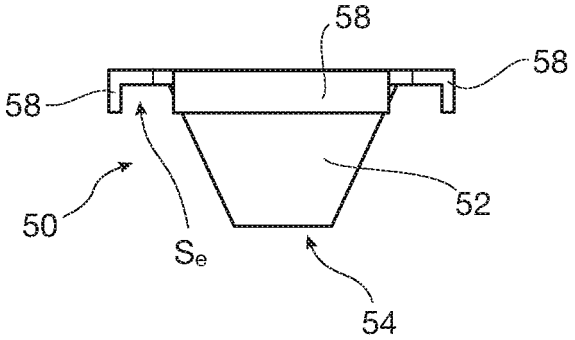
Figure 8C:
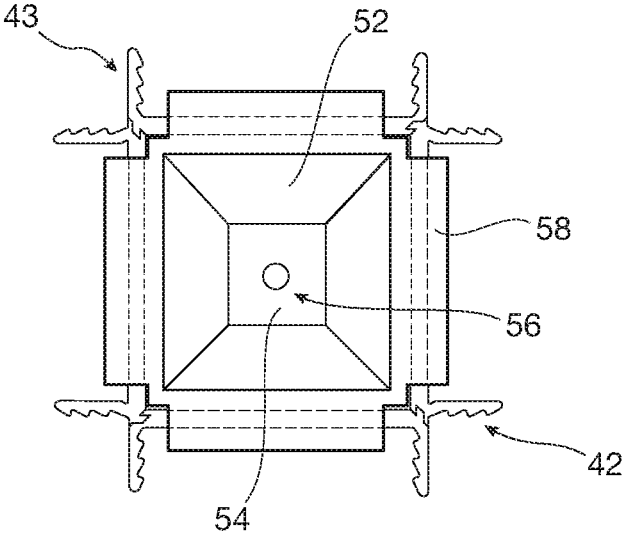

The cap 50 also comprises one or more, and in this embodiment four cap flanges 58 that are arranged at an in-use upper periphery of the cap 50. The cap flanges 58 have a portion that extends downwardly in-use, with each cap flange having a truncated side-to-side length such that it can locate between respective forward flanges 42 and 43 (when present). FIG. 8C shows the cap 50 located in the end of a corner unit 40 that is reconfigured as a 4-way junction post (i.e. with four pairs of forward flanges). The cap flanges 58 are able to locate between respective forward flanges. The cap flanges 58 also project laterally out to the extent that they can locate adjacent to (e.g. to be flush with) a respective side of the corner unit 40. In this way, the cap 50 can be push-, press- or interference-fitted onto the end of the corner unit 40.

An underside of the upper periphery of the cap 50 can be provided with a sealing element $S_e$ that in use is arranged intermediate the cap and an upper end of the corner unit 40. This sealing element can be formed from a material (e.g. elastomer or rubber gasket, etc.) that can deform under compression so as to conform to, and create a seal between, the cap 50 and the upper end of the corner unit 40. This serves to waterproof the corner unit 40 and thus the wall end in use.

Figure 8E:
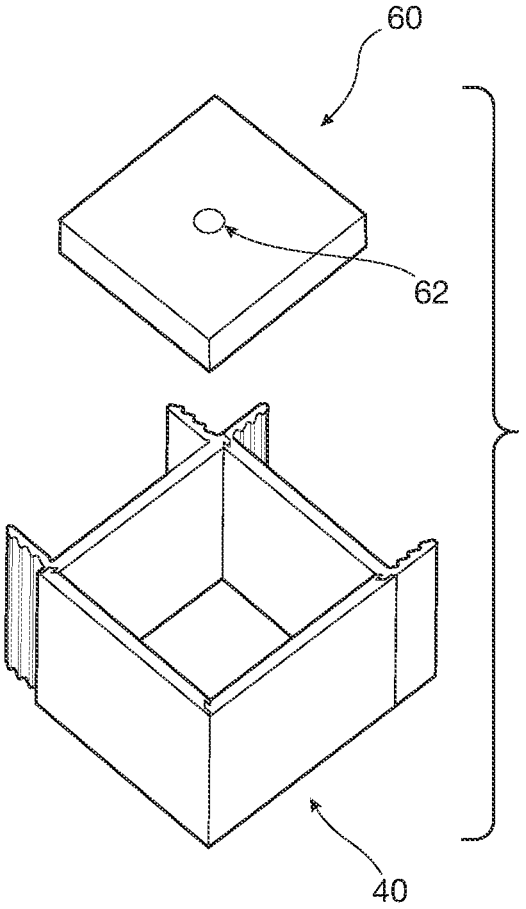

FIG. 8E also depicts a support plate in the form of a base plate 60 that is sized to locate under and support thereon a lower end of the corner unit 40 in use. The base plate 60 is also provided with an aperture 62 therethrough, with the aperture arranged to also receive the tensioning rod 21 therethrough in use. The base plate 60 ensures that the corner unit 40 is at the same level as the construction units U, U' when constructing a shelter S or shed/garage G in use. In this regard, typically the lower region of each construction unit U, U' is supported in a channel in the form of a base plate 19 (as described in greater detail hereafter). Thus, the base plate 60 sits next to and aligns with the web (base) of the base plate 19, so that the corner unit 40 is level with the construction units U, U'.

Figure 9:
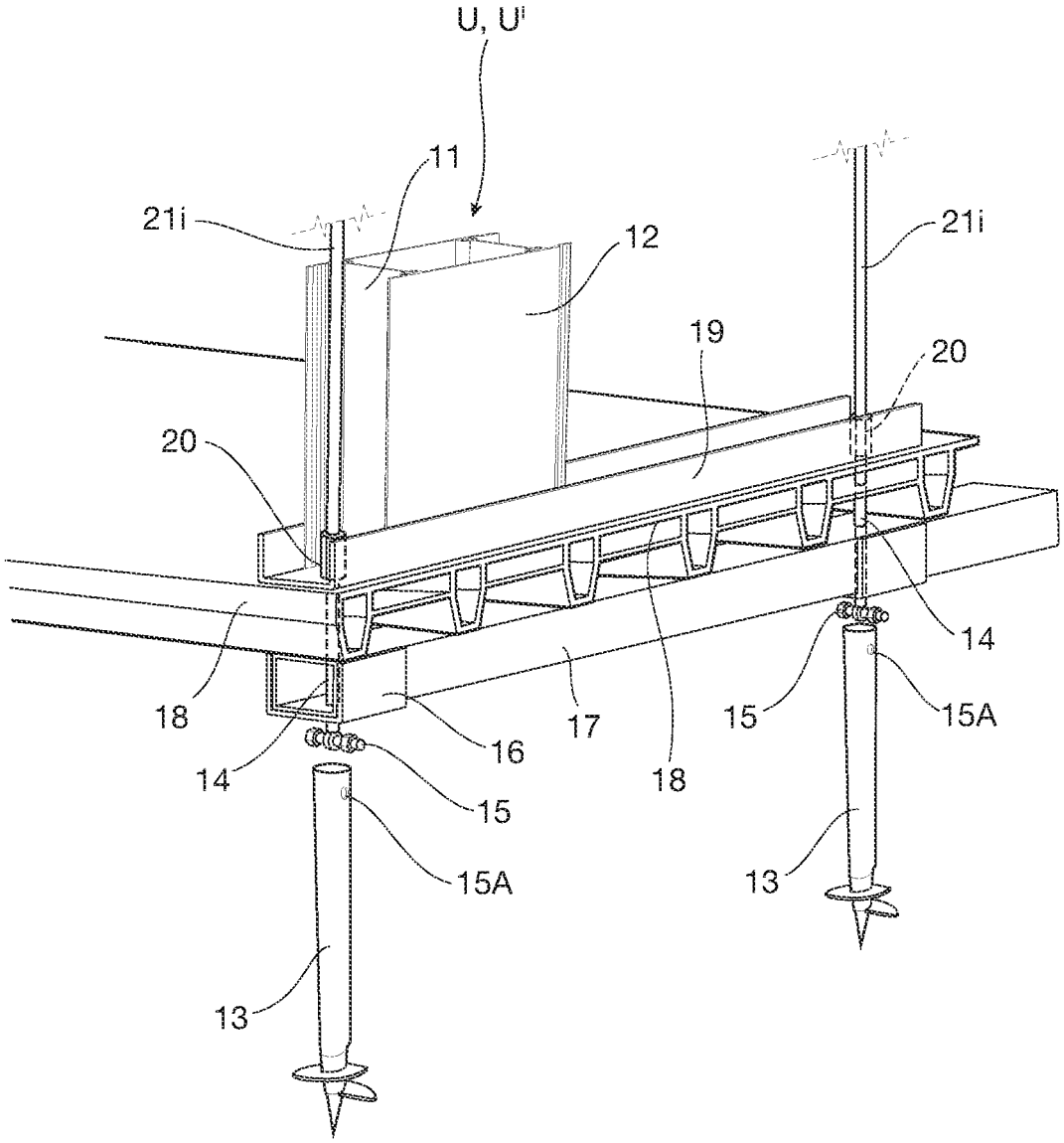
FIGS. 9 and 10 are perspective and elevation views showing a stage in the assembly of a wall structure onto a floor assembly and screw pile foundation according to an embodiment.

Referring now to FIG. 9, which shows a mid-wall section of e.g. the shelter S or shed/garage G, at a stage that is part-way through construction, it will be seen that the lower region of each construction unit U, U' is supported within a channel in the form of a U-section base plate 19. The base plate 19 has previously been secured (e.g. by fasteners) to a floor panel 18 of the shelter S or shed/garage G. The construction units sit on a web of the base plate 19 and or lower portion thereof sits snugly within the channel defined thereby (i.e. this supports each unit in an upright manner before it is joined to a next unit). The construction units are progressively assembled by urging them together until they are joined end-to-end, to form the wall structure 12 extending along the base plate 19.

The floor structure of the shelter S or shed/garage G comprises the floor panel 18 which, in turn, is supported on floor bearers 17. The floor bearers 17 sit in and are supported by support brackets 16. A screw coupling 14 for a lower end of each intermediate tensioning rod 21*i* extends through a respective support bracket 16, with this coupling 14 being connected to a rod stop in the form of a transverse pin assembly 15. The transverse portion of the pin 15 bears against the underside of a respective support bracket 16 when the intermediate tensioning rod 21*i* is tensioned.

Figure 10:
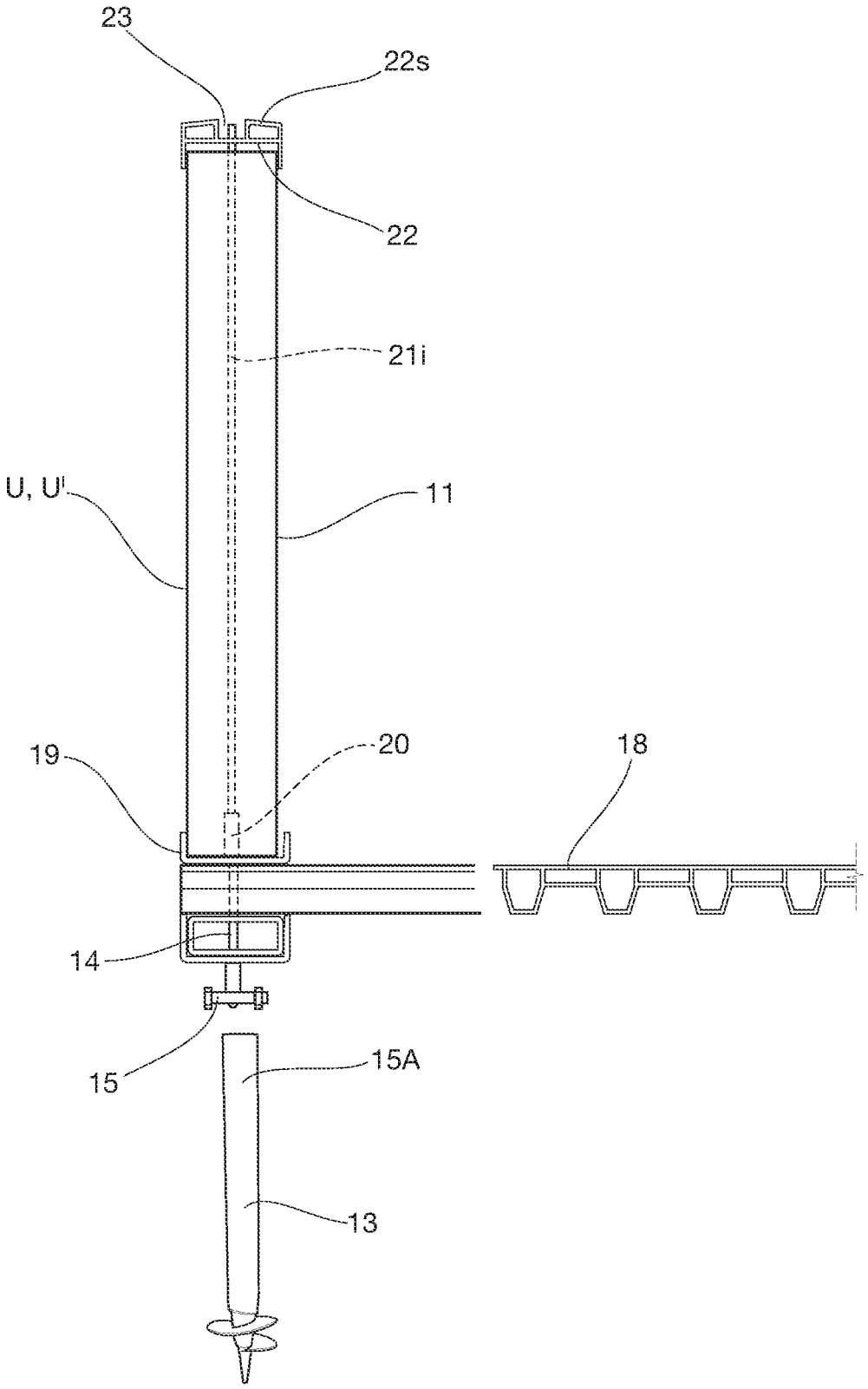

As best shown in FIG. 10, an optional coupling joiner bolt 20 can be arranged on the rod 21 to engage with and bear down on the web (base) of the base plate 19. This can secure the floor structure together on the floor bearer assembly (i.e. prior to supporting each construction unit U, U' within the base plate 19, and prior to securing the corner unit to the construction units and corner tensioning rod 21).

Figure 11A:
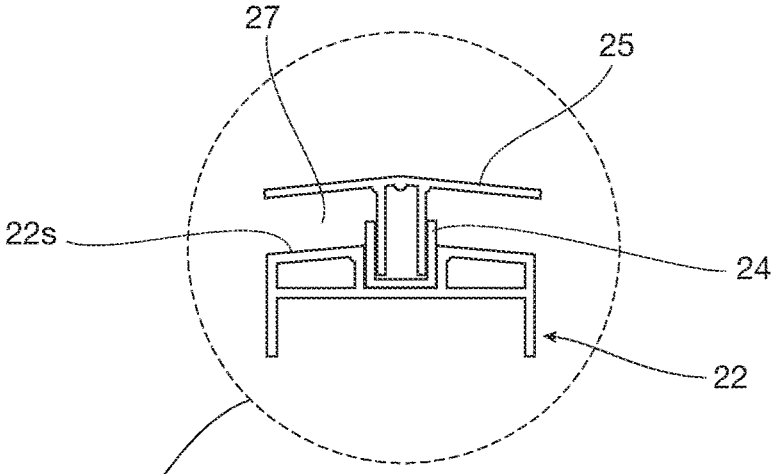
FIGS. 11 and 11A respectively show a perspective view and a detail of a stage in the assembly of a corner unit and a roof assembly according to an embodiment.
Figure 11:
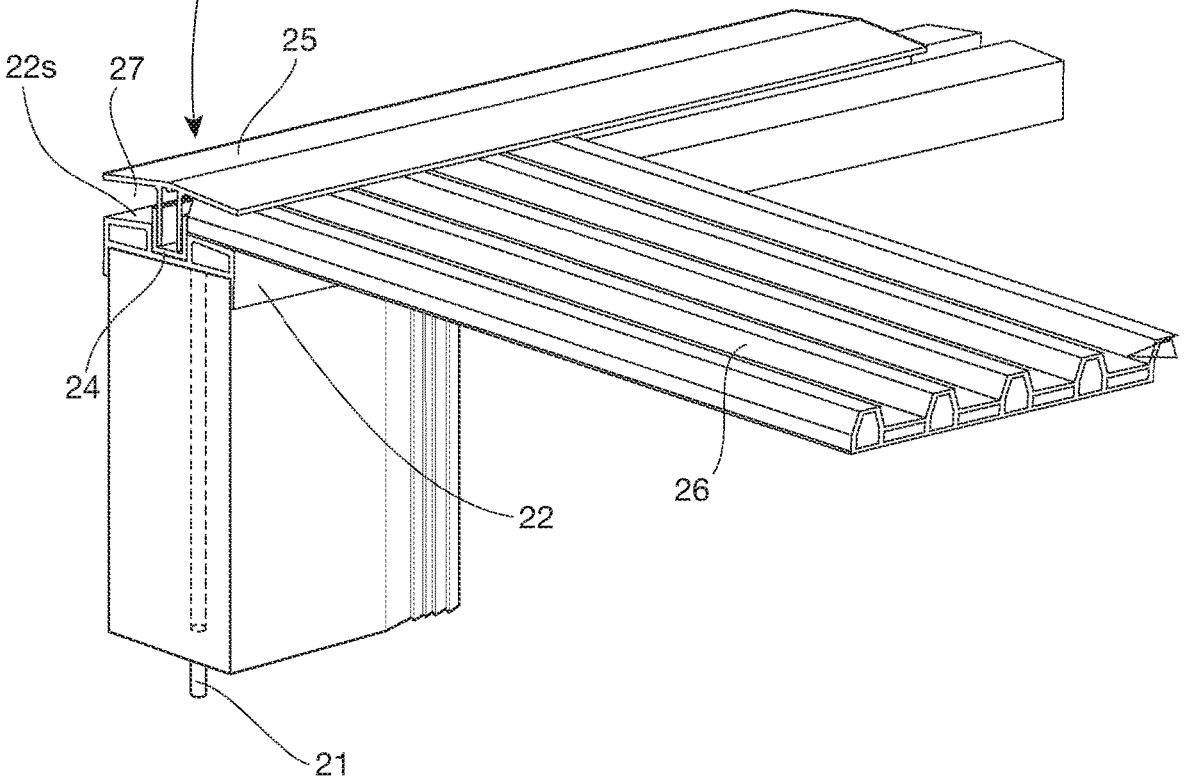

As also shown in FIG. 10, each intermediate tensioning rod 21*i* extend ups through e.g. the centre cavities 11 of each construction unit U, U', the rod extending beyond an upper region of each construction unit U, U'. The upper region of each construction unit can also be supported within an inverted channel in the form of a U-section top plate 22. The top plate 22 in FIGS. 10 and 11 is modified compared to the top plate 22 shown in FIGS. 12 and 16, in that it is provided with sloped surfaces 22*s*. These sloped surfaces 22*s* are employed when constructing a single storey structure, and help to direct rain away from the roof. They can also support sloping roof sheets 26, as shown in FIG. 11.

Again, as best shown in FIG. 10, the intermediate rods 21*i* extend through specific apertures defined in the web of the top plate 22. A fastener (e.g. tension nuts, etc.) is then turned down on each of the rods 21*i* to bear down on the web of the top plate 22. This preloads the wall in vertical compression to thereby provide a stable rigid structure, which is locked onto the floor panels 18. When e.g. a cementitious has been filled into the cavity 11 of each unit U, U', such material may bind with and be reinforced by each intermediate tensioning rod 21*i*.

As also shown in FIG. 11, a central slot 23 defined between the sloped surfaces 22*s* of the top plate 22 is then fitted with a sheet stop 24 and a top ridge cap 25. Individual roof sheets 26 are then slid into cavities 27 defined between the top plate 22 and ridge cap 25 to abut up against the sheet stop 24. Instead of roof sheets, the floor panel 18, which has been inverted, can be employed.

Referring back to FIGS. 9 and 10, it will be seen that the pin assembly 15 is received at the upper end 15A of a respective foundation screw pile 13 (these piles 13 may e.g. be of a type available from Paalupiste Oy of Hallitie, Finland). The screw piles 13 have been turned into the ground at spaced locations using mechanised or manual methods known to a person skilled in the art. The upper end 15A of each pile 13 connects and aligns with the transverse pin assembly 15.

Figure 12:
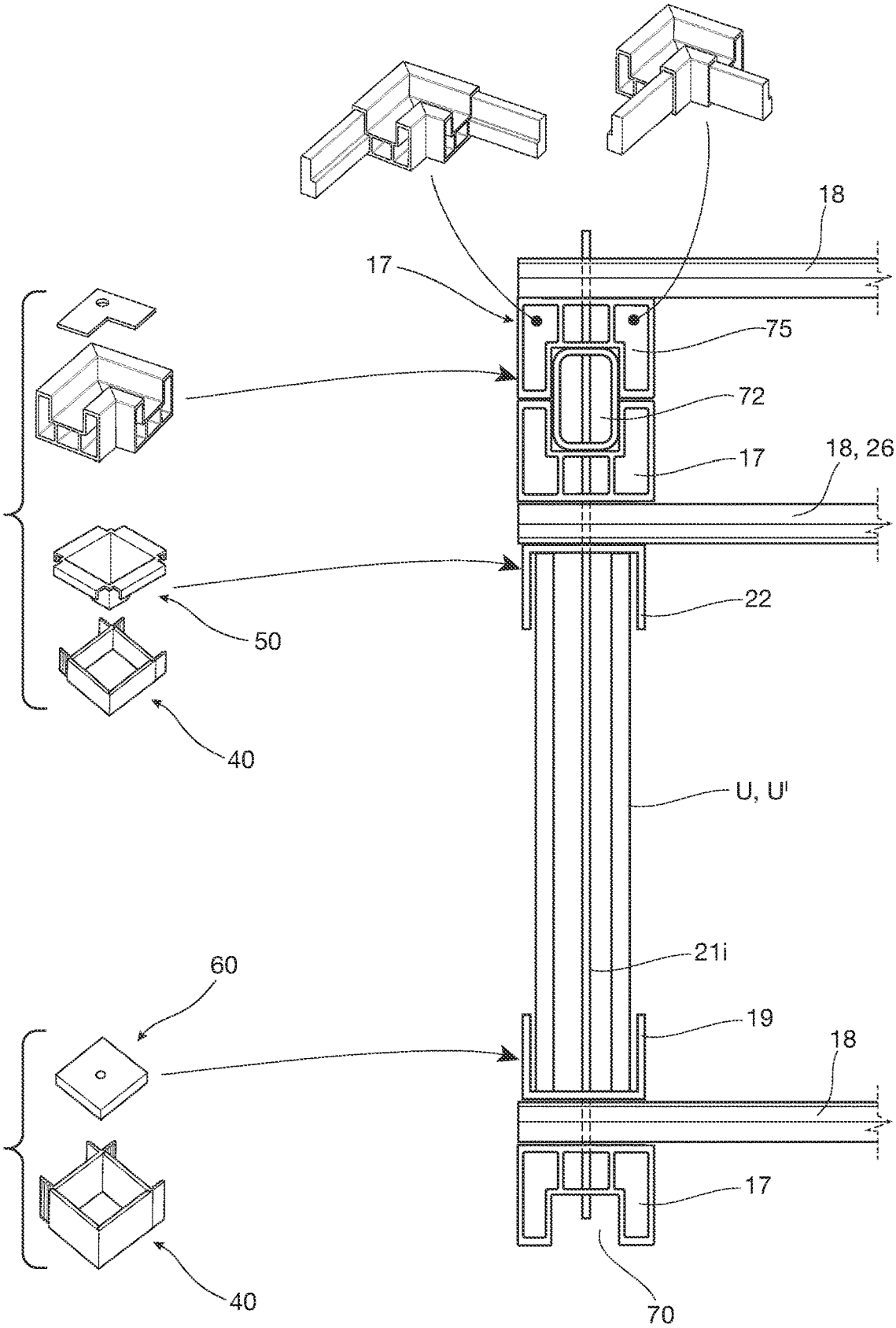
FIG. 12 is a front schematic view showing a stage in the assembly of a wall structure onto a floor assembly as well as an assembly for a further storey, according to an embodiment.

Referring now to FIG. 12, in which like reference numerals are used to denote similar or like parts, a section of a wall of a structure that is adjacent to a corner is shown, and at a stage that is part-way through construction. The structure shown in FIG. 12 is part way through preparation for a further (upper) storey to be constructed on the structure.

Figure 13:
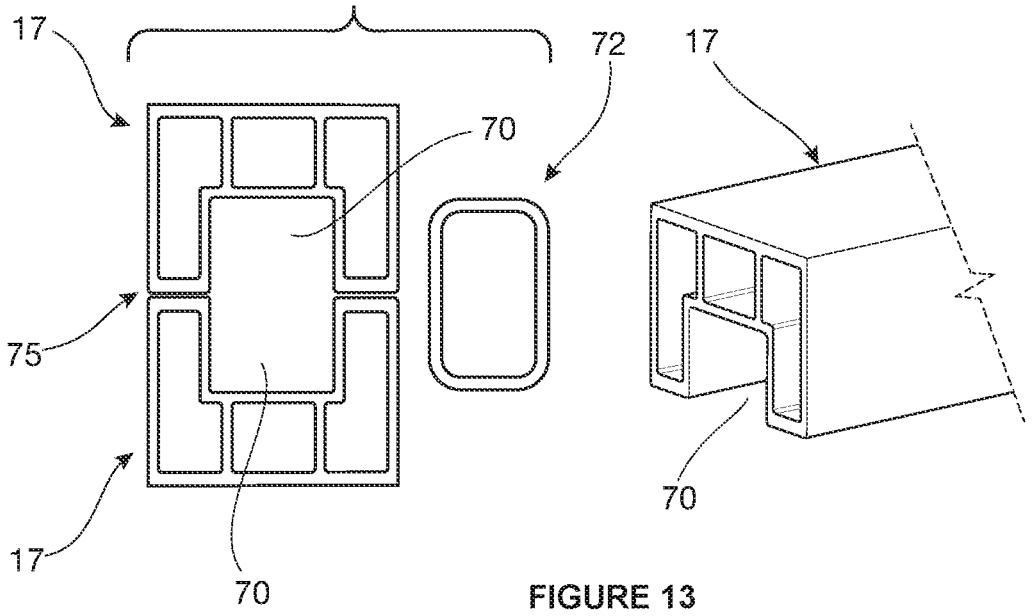
FIGS. 13 to 15 show a number of perspective views of floor/roof bearers, and corner joiner elements for use with such floor/roof bearers.

In FIG. 12, the structure of the lower storey is essentially the same as for FIGS. 9 and 10, except that the floor bearer 17 is formed to have a plurality of elongate hollow channels therethrough (i.e. so as to have a type of honeycomb profile). The channels lighten the bearer 17 but the honeycomb profile structure strengthens the bearer throughout its length. Because of this structure, the floor bearer 17 may also be prefabricated from a fibre reinforced polymer such as (but not limited to) vinyl ester, etc. and may be formed using a Pultrusion process. The floor bearer 17 also has a profile that defines an elongate channel 70 along its length (see also FIG. 13).

In addition, the top plate 22 is the same as the floor or bottom plate 19, except inverted. This means that the web of the top plate 22 is therefore flat, and thus the roof sheet 26, or in this case the floor panel 18, can sit flat and horizontal on the web of the top plate 22. Again, the re-use of the floor panel 18 as the ceiling of the lower storey can simplify overall construction.

FIG. 12 also shows how a further (upper) storey can be constructed on the structure. In this regard, a similar floor bearer 17 that has a plurality of elongate hollow channels therethrough is inverted and secured to the ceiling 18, 26 of the lower storey. This then allows a floor bearer assembly to be formed. In this regard, an interconnection member in the form of an elongate locking element 72 (e.g. of an elastomeric or polymeric rubber) can be located in the upwardly facing channel 70 of the floor bearer 17 that been secured on the ceiling 18, 26. The locking element 72 can locate and extend snugly or interferingly in and along the channel 70.

Then, another floor bearer 17 can be arranged over the secured floor bearer 17, with the locking element 72 being received in the downwardly facing channel 70 of the overlying floor bearer (e.g. snugly or interferingly in and along the downward channel 70). This serves to lock these opposing floor bearers 17 together to thereby define a unitary floor bearer assembly 75. Defining the floor bearer assembly 75 as a unit further enhances the structural properties of the resultant bearer assembly for supporting a further storey.

A further floor panel 18 for the upper storey is now arranged on (e.g. to be secured to) the floor bearer assembly 75. It will also be seen that the intermediate tensioning rod 21*i* is provided with a length such that it extends beyond the further floor panel 18 for the upper storey. Thus, a compression force is able to be applied to the entire arrangement as shown in FIG. 12.

Completion of the upper storey is then essentially a repeat of the lower storey methodology. In this regard, channel sections as base plates 19 are arranged at the further floor panel 18. Tensioning rods 21*i* are secured to the existing tensioning rods via rod couplers. Construction units U or U' are arranged at the base plates, with the further tensioning rods 21*i* extending through respective cavities 11. Channel sections as top plates 22 are arranged along and on top of the construction units. A roof panel 26 is then secured to the top plates 22.

FIG. 12 also schematically depicts location into the structure of the corner units 40, including top cap 50 and base plate 60. Additionally, FIG. 12 schematically depicts a number of bearer corner components in the corner joiners 80. These corner joiners 80 are used to join two adjacent floor bearers 17—i.e. when they converge at a corner of the structure. These corner joiners 80 are shown and will be described in more detail with reference to FIGS. 14 and 15.

Figure 15C:
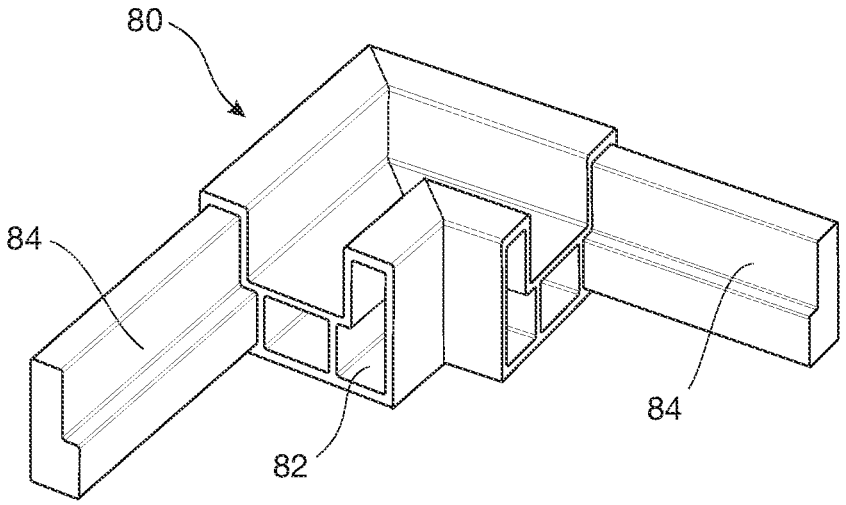
Figure 15B:
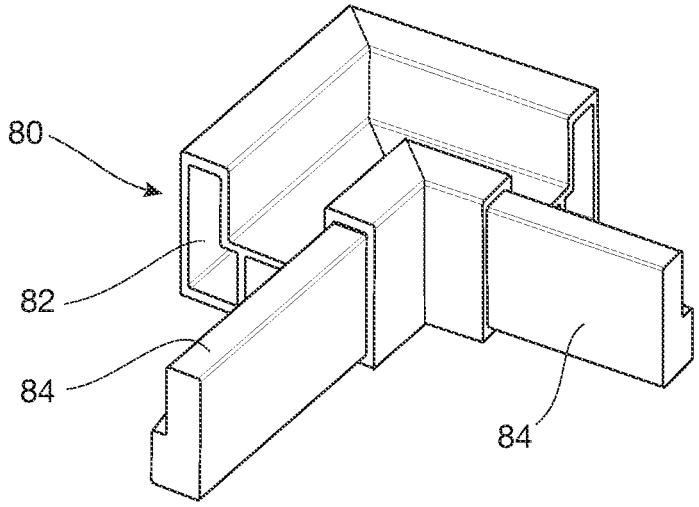
Figure 15A:
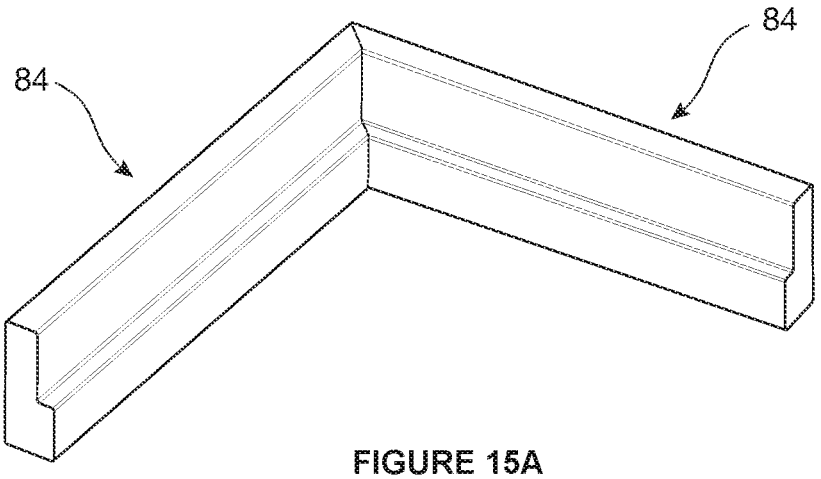

Each corner joiner 80 is shown a right angle component that comprises hollow channels 82 arranged to match the hollow channels of the floor bearers 17. As shown in FIGS. 15B and C, these channels 82 receive an elongate, typically elastomeric/polymeric joiner block 84 therein in a push- or interference-type fit. The blocks 84 have a matched profile and a length such that they can extend into the channels and through to the corner of the corner joiner 80. The block ends are optionally mitred so as to abut in a snug manner (i.e. as shown in FIG. 15A). The blocks 84 also have a length such that they can protrude beyond the channels 82, whereby the protruding ends can be received (e.g. in a push- or interference-type fit) in the hollow channels of the floor bearers 17. In this way, each corner joiner 80 is able to securely join together adjacent floor bearers 17 at a corner.

Figure 14:
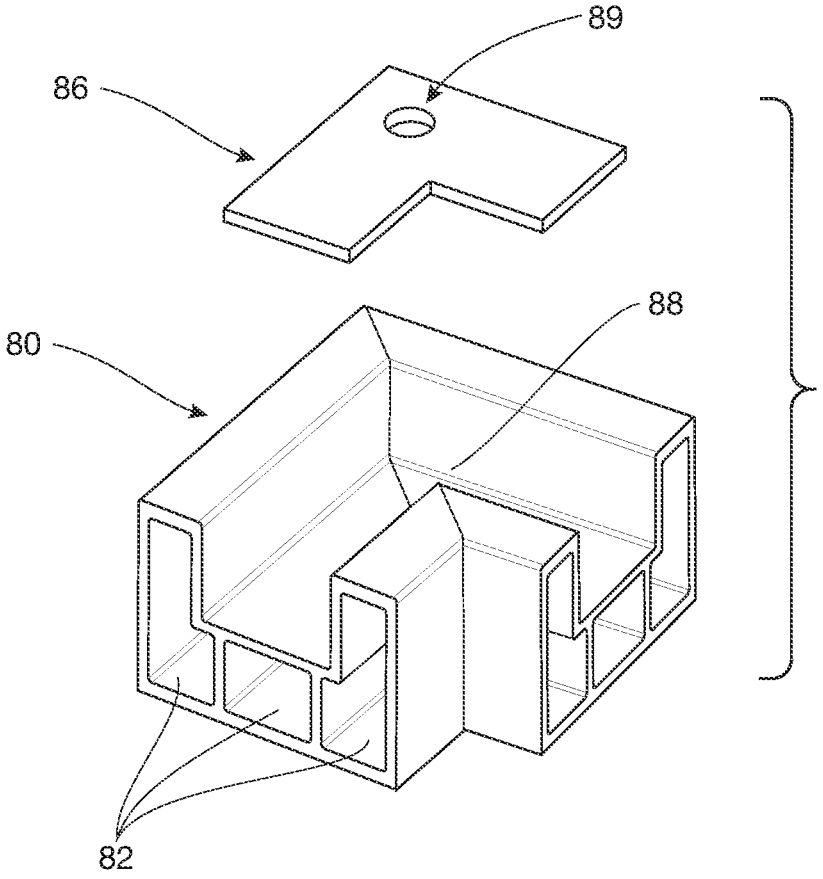

FIG. 14 also depicts an L-shaped bearing plate 86 that can be received (e.g. closely) in a corresponding L-shaped channel 88 of the corner joiner 80. An aperture 89 is provided in the bearing plate 86, whereby a corner tensioning rod 21 can extend through the aperture 89. A fastener provided on the corner tensioning rod 21 can bear down on the plate to tie the corner joiner 80, and to thus tie the floor bearers 17, to the corner structure.

Figure 16B:
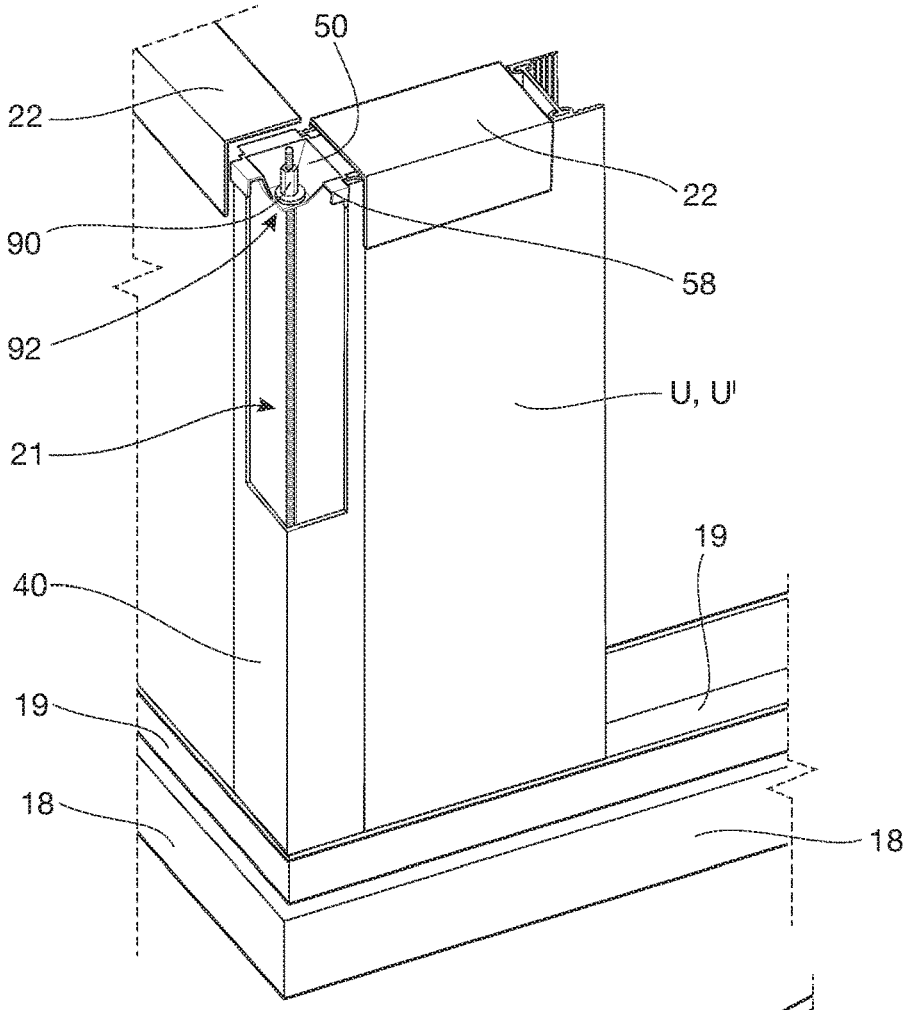
FIGS. 16A and 16B respectively show: a perspective detail; and a perspective part-sectioned detail or a corner of a structure according to an embodiment.
Figure 16A:
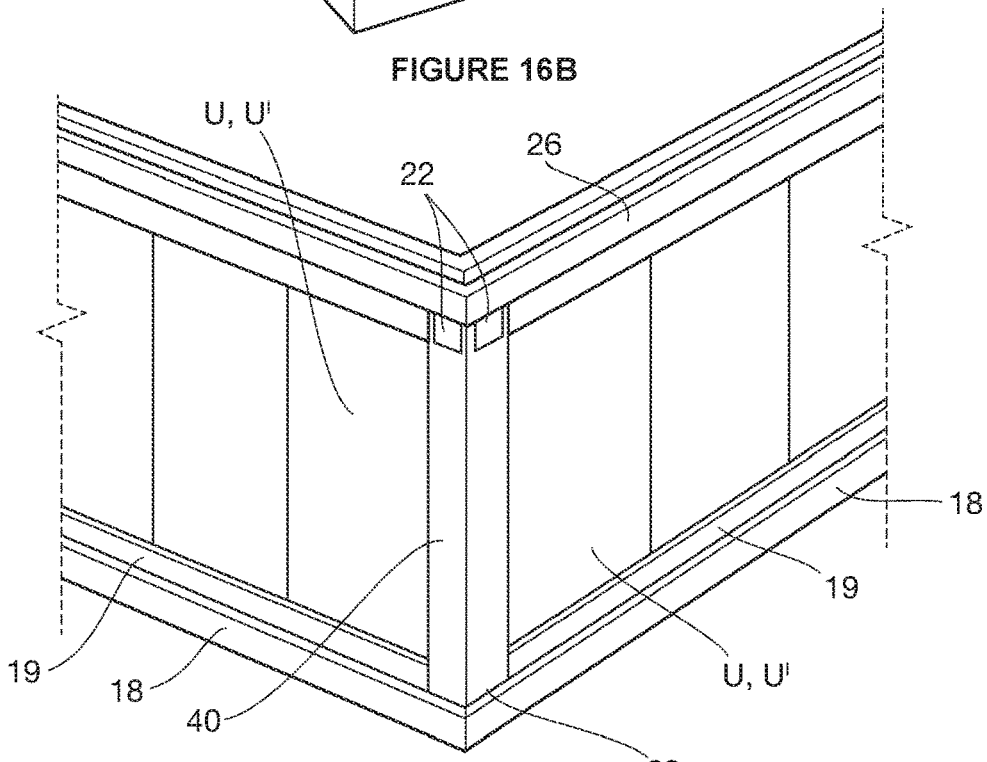

Referring now to FIG. 16, detail views are provided of a corner of a structure (such as the shelter S or shed/garage G of FIGS. 1 to 1B). FIG. 16B is part-sectioned to help reveal an inner portion of the corner. Like reference numerals are used to denote similar or like parts to those previously described.

In the corner structure, typically an end of each bottom plate 19 does not extend right into the corner (i.e. the channel terminates before the corner). Instead the upwardly extending side flanges of each bottom plate channel lie adjacent to and abut a respective corner unit 40. This termination of the bottom plates 19 provides a region into which the base plate 60 is arranged. As set forth above, the base plate 60 enables each corner unit 40 to be generally level with an adjacent construction unit U, U', a support plate may be arranged under each such post section On the other hand, for a single storey structure, the end of each top plate 22 extends right into the corner to overlie an upper end of the corner post (i.e. to overlie the top cap 50). Typically, the channels of each top plate 22 are mitre-cut so that each plate is able to meet in a flush manner in the corner.

In FIG. 16B the top plates 22 are shown cut-away. However, if a second storey is to be constructed, whereby the corner tensioning rod 21 would be extended, then a cut-away of the top plates 22 as shown would be employed.

FIG. 16B also illustrates a fastener mechanism for arrangement in the top cap 50 and for bearing down on the recessed base 54 of the cap 50. The fastener mechanism comprises an internally threaded bolt 90 which is configured to be screwed down an external thread of the corner tensioning rod 21. A lower end of the bolt 90 is provided or engages with a bearing washer 92. The bearing washer 92 sits flat and bears against the recessed base 54 of the cap 50 when the bolt 90 is screwed down on the tensioning rod 21.

When constructing a structure such as shown in FIGS. 1 to 1B, and after having built the foundation (e.g. screw piles 13), floor bearer assembly (14, 15, 16, 17), and floor (18), typically a corner post 40 is formed and secured first to the floor 18 via the corner tensioning rod 21 and the fastener mechanism arranged in the inserted top cap 50. The corner unit 40 is placed into compression via the fastener mechanism. In some applications, the corner post may be in-filled with a fill material (such as a cementitious material, expandable polymer, etc.) so as to act as an anchor for the structure.

Discrete, spaced intermediate tensioning rods 21*i* can now be arranged to extend from the floor bearer assembly (14, 15, 16, 17), with each rod extending through a base plate 19. Construction units U or U' can now be arranged on the intermediate tensioning rods 21*i* (in the case of unit U'—see FIG. 3B, a given tensioning rods 21*i* can extend through the integrally formed conduit 36). The units U, U' are engaged and lock end-to-end with other like units U, U' to form a length of wall structure 12 (i.e. as shown in FIGS. 4, 6 and 16).

At various points along the wall structure 12, intermediate joiner posts 47 and 3-way joiner posts may be deployed, with each intermediate post typically also constructed around an intermediate tensioning rod 21*i*. Internal walls and doors etc. may run off these intermediate posts, and 4-way joiner posts may be deployed internally.

Top plates 22 are now arranged along the wall structure 12. The intermediate tensioning rods 21*i* can each extend through a given top plate. Thus, when each intermediate rod 21*i* is tensioned via a fastener mechanism that acts on the top plate 22, the wall section 12 is placed into compression (i.e. a compressive retention force is applied to the construction units located between the top and bottom plates). In this way, a very strong, stable and robust wall results.

The intermediate posts and construction units may also be in-filled with a fill material (such as a cementitious material, expandable polymer, etc.) to provide a stable fixing point as the walls are erected.

Finally, the roof can be mounted to the structure to enclose the same, such as by using arrangements similar to those set forth above in relation to FIG. 11. Where a second storey is to be constructed, the arrangements as set forth above in relation to FIG. 12 can be employed.

The panel 6 in the form of the embodiments disclosed herein provides a unique and improved building panel for e.g. low cost shelters. Components for the shelter can be prefabricated (e.g. from fibre reinforced polymer components which can be manufactured off-site, such as by a Pultrusion process). The components can be packaged and bundled (e.g. flat-packed) as a construction kit, with all associated instructions and parts supplied.

A basic plan for the shelter can be a square or rectangular module which can be flat-packed for ease of shipping and road transport. A standard living module can be provided that has an enclosed area of 16.5 square metres which may be added to in any number of configurations and is not limited in size or shape.

A further unique feature of the construction units is the ability for them to be easily disassembled without any damage to the webs 9 or clutches 8. By removing the top plate 22 the internal web 9 are easily slid out from the female clutches. This releases the tension on the internal and external face panels 6 and allows the saw teeth ridges 7 to disengage from each other and be removed from the unit.

Where two or more tensioning rods are deployed along a wall structure 12, this can allow differing compressive forces to be applied along the wall as well as at the corner sections (the latter which may be fabricated to have a greater compression force applied thereto to act as anchor points). This can allow for an optimal compressive force profile to be applied to each section of the structure, securing the structural components in place whilst avoiding buckling/bowing associated with excessive compressive forces.

It is to be understood that a wide range of modifications to the shape and configuration of the building panel and various associated components may be made, without departing from the spirit or ambit of the disclosure.

In the claims which follow and in the preceding summary except where the context requires otherwise due to express language or necessary implication, the word "comprising" is used in the sense of "including", that is, the features as above may be associated with further features in various embodiments.

The invention claimed is:

1. A panel for use in construction, the panel comprising:

opposing inwards and outwards surfaces that extend between first and second opposite ends of the panel;

a plurality of parallel ridges provided only on the inwards surface at the first end of the panel, the ridges extending along and adjacent to the first end for at least a part length thereof;

a plurality of parallel ridges provided only on the outwards surface at the second end of the panel, the ridges extending along and adjacent to the second end for at least a part length thereof, wherein the ridges of the panel are arranged to engage with and move past corresponding ridges of a second, adjacent and like panel when the panels move relative towards each other in respective planes of the panels in opposite directions, and wherein the ridges of the panel are further arranged so as to interfere with the corresponding ridges of the second adjacent panel to resist relative movement in a reverse of the opposite directions towards each other;

and one or more formations provided on the inwards surface, each formation being configured to releasably engage with a respective transverse web in use.

2. The panel according to claim 1, wherein the plurality of ridges provided at the inwards and outwards surfaces, respectively at the first and second ends extend for a full length of the first and second ends.

3. The panel according to claim 1, wherein, for each panel, the second end is offset but parallel to a plane of the first end, such that, when the ridges at the outwards surface of the second end of the second panel are engaged with corresponding ridges at the inwards surface of the first end of an adjacent and like first panel, the outwards surface of the second panel is able to be flush with the outwards surface of the first panel.

4. The panel according to claim 3, in combination with a like and opposing panel to the first panel, and wherein the opposing panel is able to be inverted such that its parallel ridges at the opposing panel first end are able to oppose and face the parallel ridges provided at the first panel first end, and such that the parallel ridges at the opposing panel second end face outwardly in an opposite direction to the parallel ridges provided at the first panel second end.

5. The panel combination according to claim 4, further comprising one or more of said transverse webs, wherein each web is arranged to extend between the opposing panel and the first panel in use, with opposite ends of each web being configured to releasably engage with a respective web-engaging formation provided at one of the inwards surfaces of the first panel and the opposing panel to thereby connect the first panel and the opposing panel.

6. The panel combination according to claim 5, wherein the one or more webs are releasably connected via respective web-engaging formations in the form of one or more slotted clutches that extend for at least part of the length of each of the inwards surfaces of the first panel and the opposing panel.

7. The panel according to claim 1, wherein the first and the second opposite ends of the panel are each defined by a projecting flange, with the ridges being provided adjacent to a distal edge of each flange, and wherein each flange is arranged to deflect in use as the ridges engage with and move past corresponding ridges of an adjacent panel when the panels are moved relative to each other in said opposite directions.

8. A method of construction that employs a plurality of panels, each as set forth in claim 1, the method initially comprising forming a construction unit by:

arranging a first panel;

arranging an opposing like panel adjacent to and generally in parallel with the first panel, the opposing panel being inverted with respect to the first panel such that the ridges at the opposing panel first end are able to oppose and face the ridges at the first panel first end, and such that the ridges at the opposing panel second end face outwardly in an opposite direction to the ridges at the first panel second end;

arranging one or more webs to extend between and releasably connect the first and opposing panels via their opposing first inwards surfaces to define the construction unit.

9. The method according to claim 8, wherein two spaced webs are arranged to extend between and releasably connect the first and opposing panels via their opposing inwards surfaces so as to define the construction unit as a box section.

10. The method according to claim 8, wherein like construction units are joined together end-to-end to form a wall section by bringing into engagement the ridges located at each of the first ends of the first and the opposing panels of a first construction unit, with corresponding ridges located at the opposing ends of the respective first and the opposing panels of a like construction unit.

11. The method according to claim 8, the method further comprising arranging a post section for location at the end of one, or at the end of a series of construction units that have been joined together end-to-end, wherein the post section comprises opposing parallel flanges that project from a side of the post section, each flange comprising a plurality of corresponding ridges that are arranged to engage with the ridges at either the first end or second end of a respective panel of the construction unit.

12. The method according to claim 11, wherein first opposing and parallel flanges project from one side of the post section and wherein second opposing and parallel flanges project from another side of the post section, the first flanges extending in a different direction to the second flanges.

13. The method according to claim 12, wherein the first flanges project orthogonally from the post section with respect to the second flanges to define the post section as a corner section; or the first flanges project from an opposite side of the post section to the second flanges to define the post section as a two-way joiner section; or the first flanges project from an opposite side of the post section to the second flanges, and wherein opposing and parallel third flanges project orthogonally from a side of the post section and with respect to the first and the second flanges to define the post section as a three-way joiner section; or the first flanges project from an opposite side of the post section to the second flanges, and wherein opposing and parallel fourth flanges project orthogonally from a side of the post section with respect to the first and the second flanges, and project in an opposite direction to the third flanges, to define the post section as a four-way joiner section.

14. The method according to claim 12, wherein a plurality of post sections are arranged together with the construction units to define the structure.

15. The method according to claim 12, the method further comprising arranging a cap at an in-use upper end of the post section, the cap arranged to receive a tensioning rod therethrough in use, such that a compression force can be applied to the cap when arranged at the upper end of the post section in use.

16. The method according to claim 14 wherein, prior to arranging the construction units and post sections to define the structure, a channel section that is upwardly open in use is provided at a base of the structure, the channel section defining a base plate of a respective wall of the structure and being dimensioned such that an in-use lower region of each of one or more construction units and/or post sections is able to be located within the channel section.

17. The method according to claim 16, wherein a plurality of first channel sections are arranged at a floor panel of the structure, each channel section defining a base plate of a respective wall of the structure, and wherein a plurality of second channel sections are arranged to receive and locate an in-use upper region of each of one or more construction units of the structure, each second channel section defining a top plate of a respective wall of the structure.

18. The method according to claim 17, wherein the floor panel is located at a floor bearer assembly, and wherein one or more discrete, spaced tensioning rods are provided intermediate the post sections, each intermediate rod extending from the floor bearer assembly, through a base plate, through a construction unit, and through a top plate, such that, when each intermediate rod is tensioned in use, it draws the base and top plates together to thereby apply a compressive retention force to the one or more construction units located therebetween.

19. The method according to claim 18, the method further comprising constructing a further storey of the structure by:

arranging a bearer assembly at a roof panel;

arranging a floor panel for the further storey at the bearer assembly;

arranging one or more channel sections as base plates at the floor panel of the further storey;

arranging the one or more further construction units at the base plates;

wherein the bearer assembly comprises first and second like elongate bearer elements, the second bearer element being inverted with respect to and arranged underneath so as to face the first bearer element in use.

20. The method according to claim 11, the method further comprising:

arranging a cap at an upper end of the post section; and arranging a tensioning rod that is configured to be secured at a lower end thereof to extend through each of the post section and cap, and such that a compression force can be applied to the cap via the tensioning rod when the cap is arranged at the upper end of the post section in use.

* * * * *